US011701878B2

(12) United States Patent
Adachi et al.

(10) Patent No.: US 11,701,878 B2
(45) Date of Patent: Jul. 18, 2023

(54) LIQUID EJECTING DEVICE, CONTROL METHOD FOR LIQUID EJECTING DEVICE AND CONTROL PROGRAM FOR LIQUID EJECTING DEVICE

(71) Applicant: SEIKO EPSON CORPORATION, Tokyo (JP)

(72) Inventors: Hirohisa Adachi, Matsukawa-machi (JP); Yoichiro Maki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 113 days.

(21) Appl. No.: 17/447,737

(22) Filed: Sep. 15, 2021

(65) Prior Publication Data

US 2022/0088921 A1 Mar. 24, 2022

(30) Foreign Application Priority Data

Sep. 18, 2020 (JP) ..... 2020-157452

(51) Int. Cl.
*B41J 2/045* (2006.01)

(52) U.S. Cl.
CPC ..... *B41J 2/04508* (2013.01); *B41J 2/04586* (2013.01)

(58) Field of Classification Search
CPC ..... B41J 2/04508; B41J 2/04586
See application file for complete search history.

(56) References Cited

U.S. PATENT DOCUMENTS 8,382,241 B2 * 2/2013 Saitoh ..... B41J 2/16526 347/35
2018/0141333 A1 5/2018 Kurokawa

FOREIGN PATENT DOCUMENTS

| | | | |
|---|---|---|---|
| JP | 2005-004259 | A | 1/2005 |
| JP | 2007-021905 | A | 2/2007 |
| JP | 2018-083350 | A | 5/2018 |
| JP | 2018-165023 | A | 10/2018 |

* cited by examiner

*Primary Examiner* — Thinh H Nguyen
(74) *Attorney, Agent, or Firm* — Workman Nydegger

(57) ABSTRACT

A recording system includes an ejecting unit, a punch unit, and a control unit. The ejecting unit ejects ink onto a sheet transported by a transport unit to form an image. The punch unit forms a plurality of through holes in the sheet. The control unit controls an ejection amount per unit area of ink in the ejecting unit based on image data. Furthermore, the control unit divides a region into a first region not including the through hole, and a second region including the through hole, and controls an ejection amount of the ink in the ejecting unit such that a second ejection amount per unit area when an image is formed in the second region is less than a first ejection amount per unit area when an image is formed in the first region.

13 Claims, 17 Drawing Sheets

DT

| SHEET THICKNESS [mm] | FIRST EJECTION AMOUNT: d1 [LITERS/SQUARE METER] | SECOND EJECTION AMOUNT: d2 [LITERS/SQUARE METER] |
|---|---|---|
| T1 | da | db |
| T2 | dc | dd |
| T3 | de | df |

FIG. 6

LIQUID EJECTING DEVICE, CONTROL METHOD FOR LIQUID EJECTING DEVICE AND CONTROL PROGRAM FOR LIQUID EJECTING DEVICE

The present application is based on, and claims priority from JP Application Serial Number 2020-157452, filed Sep. 18, 2020, the disclosure of which is hereby incorporated by reference herein in its entirety.

BACKGROUND

1. Technical Field

The present disclosure relates to a liquid ejecting device, a control method for a liquid ejecting device, and a control program for a liquid ejecting device.

2. Related Art

A printing data processing device described in JP 2005-4259 A, when a printing region overlaps a holed portion, converts print data to exclude the overlapping portion from the printing region so that a portion of the printed region overlapping the holed portion is not printed, and sends the converted print data and generated process portion data to a printing apparatus. The printing apparatus including a processing head performs printing and holing in parallel based on the received print data and processing portion data.

In the configuration of JP 2005-4259 A, when a mounting position of the processing head is shifted from a set position, there is a possibility that, even when an overlapping portion is excluded from a printing region of a medium, a position of a hole formed in the excluded portion is shifted, and a position shift of the hole may be conspicuous.

SUMMARY

A liquid ejecting device according to the present disclosure for solving the above-described problem includes an ejecting unit configured to eject liquid onto a medium transported by a transport unit to form an image, a hole forming unit configured to form a plurality of through holes, arranged in a width direction intersecting a transport direction of the medium, in the medium onto which the liquid was ejected from the ejecting unit, and a control unit configured to control an ejection amount of the liquid per unit area from the ejecting unit based on image data, wherein the control unit divides a region in the medium in which an image is formed based on the image data into a first region not including the plurality of through holes, and a second region including the plurality of through holes, and controls an ejection amount of the liquid from the ejecting unit, so that a second ejection amount per unit area when an image is formed in the second region is less than a first ejection amount per unit area when an image is formed in the first region.

A liquid ejecting device according to the present disclosure for solving the above-described problem includes an ejecting unit configured to eject liquid onto a medium being transported to form an image, a hole forming unit configured to form a plurality of through holes, arranged in a width direction intersecting a transport direction of the medium, in the medium onto which the liquid was ejected from the ejecting unit, and a control unit configured to control an ejection amount of the liquid per unit area from the ejecting unit based on image data, wherein the control unit divides a region in the medium in which an image can be formed based on the image data into a first region not including the plurality of through holes, and a second region including the plurality of through holes, is configured to accept input of correction data for each of the through holes for correcting a position in the width direction of the second region, corrects the position in the width direction of the second region based on the input correction data, causes the ejecting unit to eject the liquid in the first region, and causes the ejecting unit not to eject the liquid in the second region.

A control method for a liquid ejecting device according to the present disclosure for solving the above-described problem is a control method for a liquid ejecting device that includes an ejecting unit for ejecting liquid onto a medium transported by a transport unit to form an image, a hole forming unit for forming a plurality of through holes arranged in a width direction intersecting a transport direction of the medium, in the medium onto which the liquid was ejected from the ejecting unit, and a control unit for controlling an ejection amount of the liquid per unit area from the ejecting unit based on image data, the control method including a process of dividing, when the plurality of through holes are formed in the medium, a region in the medium in which an image is formed based on the image data into a first region not including the plurality of through holes, and a second region including the plurality of through holes, and a process of controlling an ejection amount of the liquid from the ejecting unit, so that a second ejection amount per unit area when an image is formed in the second region is less than a first ejection amount per unit area when an image is formed in the first region.

A non-transitory computer-readable storage medium storing a control program for a liquid ejecting device according to the present disclosure for solving the above-described problem is a storage medium storing a control program for a liquid ejecting device that includes an ejecting unit for ejecting liquid onto a medium transported by a transport unit to form an image, a hole forming unit for forming a plurality of through holes arranged in a width direction intersecting a transport direction of the medium, in the medium onto which the liquid was ejected from the ejecting unit, and a control unit for controlling an ejection amount of the liquid per unit area from the ejecting unit based on image data, the control program including a step of dividing, when the plurality of through holes are formed in the medium, a region in the medium in which an image is formed based on the image data into a first region not including the plurality of through holes, and a second region including the plurality of through holes, and a step of controlling an ejection amount of the liquid from the ejecting unit, so that a second ejection amount per unit area when an image is formed in the second region is less than a first ejection amount per unit area when an image is formed in the first region.

BRIEF DESCRIPTION OF THE DRAWINGS

FIG. 6 is an example of a data table illustrating a relationship among sheet thickness, first ejection amount, and second ejection amount used in the recording system according to Exemplary Embodiment 1.

DESCRIPTION OF EXEMPLARY EMBODIMENTS

Figure 1:
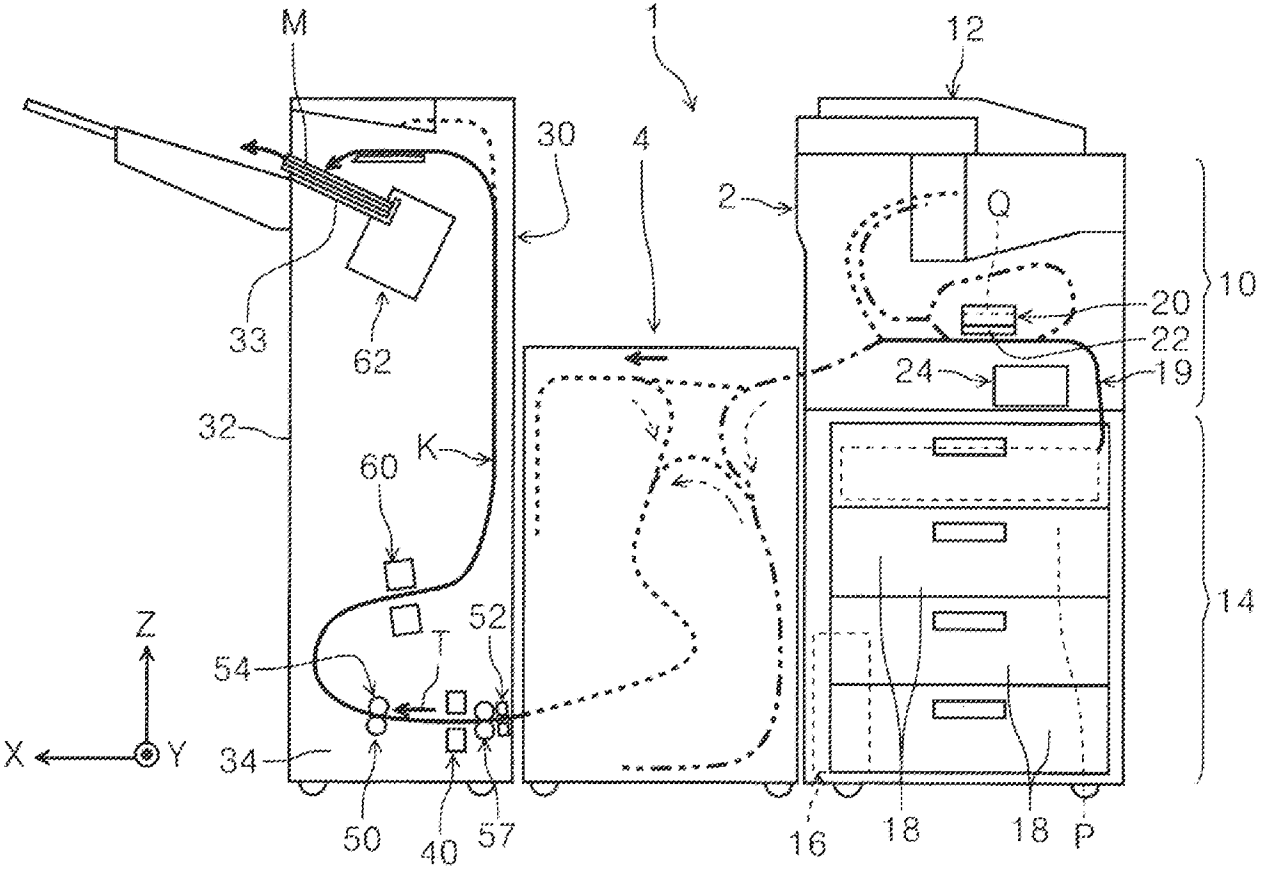
FIG. 1 is an overall view of a recording system according to Exemplary Embodiment 1.

Hereinafter, the present disclosure will be schematically described.

A post-processing device according to a first aspect of the present disclosure for solving the above-described problem includes an ejecting unit configured to eject liquid onto a medium transported by a transport unit to form an image, a hole forming unit configured to form a plurality of through holes, arranged in a width direction intersecting a transport direction of the medium, in the medium onto which the liquid was ejected from the ejecting unit, and a control unit configured to control an ejection amount of the liquid per unit area from the ejecting unit based on image data, wherein the control unit divides a region in the medium in which an image is formed based on the image data into a first region not including the plurality of through holes, and a second region including the plurality of through holes, and controls an ejection amount of the liquid from the ejecting unit, so that a second ejection amount per unit area when an image is formed in the second region is less than a first ejection amount per unit area when an image is formed in the first region.

According to the present aspect, in the first region of the medium, the liquid is ejected from the ejecting unit based on the image data to form a part of the image.

On the other hand, in the second region of the medium, an ejection amount of the liquid per unit area is set to the second ejection amount, to be less than the first ejection amount in the first region. That is, in the second region, image density of an image formed in the second region is lower than image density of an image formed in the first region. As a result, when the through hole is formed in the second region, a difference in image density between a missing part of the image due to the through hole and an image in the second region is less compared to a case where the through hole is formed in the first region, therefore, a position shift of the plurality of through holes can be prevented from being conspicuous.

Furthermore, according to the present aspect, image data of the image data corresponding to the second region remains even with low image density, and thus, the image with little loss can be obtained.

A liquid ejecting device according to a second aspect is the liquid ejecting device according to the first aspect, wherein the control unit performs division into the first region and the second region in the transport direction.

According to the present aspect, the second region is set throughout the entire width direction, so compared to a configuration in which the second region is set in a part in the width direction, a process need not be performed that reduces a shift between a position of the image in the second region and a position of the through hole.

A liquid ejecting device according to a third aspect is the liquid ejecting device according to the first or second aspect, that includes a setting unit configured to enable setting the second ejection amount, wherein the control unit controls ejection of the liquid from the ejecting unit so that an ejection amount of the liquid per unit area in the second region is the second ejection amount set by the setting unit.

According to the present aspect, the second ejection amount can be freely set by the setting unit, so the image in the second region along an intention of a user can be obtained.

A liquid ejecting device according to a fourth aspect is the liquid ejecting device according to any one of the first to third aspects, wherein the control unit includes a storage unit for storing a data table, and the storage unit stores, in the data table, thickness data of the medium, and data of the second ejection amount corresponding to the thickness data.

According to the present aspect, the thickness data of the medium and the data of the second ejection amount are stored in the data table, thus, when thickness of the medium used in the liquid ejecting device is modified, the appropriate second ejection amount of the liquid can be ejected from the ejecting unit in accordance with the thickness of the medium.

A liquid ejecting device according to a fifth aspect is the liquid ejecting device according to any one of the first to fourth aspects, wherein the control unit sets a dimension in the width direction of the second region to a dimension greater than a dimension in the transport direction of the second region.

According to the present aspect, the second region is formed to be longer in the width direction than in the transport direction, even in a configuration in which a position shift in the width direction with respect to a set position of the hole forming unit is more remarkable than a position shift in the transport direction with respect to the set position of the hole forming unit, therefore, when the plurality of through holes are formed, a position shift of the plurality of through holes can be prevented from being conspicuous.

A liquid ejecting device according to a sixth aspect is the liquid ejecting device according to any one of the first to fifth aspects, wherein the control unit is configured to accept input of correction data for each of the through holes for correcting a position in the width direction of the second region, and correct the position in the width direction of the second region based on the input correction data.

According to the present aspect, when the plurality of through holes are formed, by correcting the position in the width direction of the second region for each of the through holes, the position shift of the plurality of through holes can be further prevented.

A liquid ejecting device according to a seventh aspect includes an ejecting unit configured to eject liquid onto a medium transported by a transport unit to form an image, a hole forming unit configured to form a plurality of through holes, arranged in a width direction intersecting a transport direction of the medium, in the medium onto which the liquid was ejected from the ejecting unit, and a control unit configured to control an ejection amount of the liquid per unit area from the ejecting unit based on image data, wherein the control unit divides a region in the medium in which an image can be formed based on the image data into a first region not including the plurality of through holes, and a second region including the plurality of through holes, is configured to accept input of correction data for each of the through holes for correcting a position in the width direction of the second region, corrects the position in the width direction of the second region based on the input correction data, causes the ejecting unit to eject the liquid in the first region, and causes the ejecting unit not to eject the liquid in the second region.

According to the present aspect, in the first region of the medium, the liquid is ejected from the ejecting unit based on the image data to form a part of the image.

On the other hand, since the liquid is not ejected in the second region of the medium, image density of an image formed in the second region lowers compared to image density of an image formed in the first region. As a result, when the through hole is formed in the second region, a difference in image density between a missing part of the image due to the through hole and an image in the second region is less compared to a case where the through hole is formed in the first region, therefore, a position shift of the plurality of through holes can be prevented from being conspicuous.

A liquid ejecting device according to an eighth aspect is the liquid ejecting device according to any one of the first to seventh aspects, that includes an operation unit capable of setting a dimension in the transport direction of the second region, wherein the control unit performs division into the first region and the second region so that a dimension in the transport direction of the second region is a set dimension set by the operation unit.

According to the present aspect, the dimension in the transport direction of the second region can be freely set by the operation unit, and thus the image in the first region along an intention of the user can be obtained.

A liquid ejecting device according to a ninth aspect is the liquid ejecting device according to any one of the first to eighth aspects, that includes a modification unit capable of modifying a position in the transport direction of the medium transported to the hole forming unit, wherein the control unit is configured to accept input of transport correction data for correcting a position in the transport direction of the medium, and operates the modification unit based on the input transport correction data, to correct the position in the transport direction of the medium.

According to the present aspect, the modification unit corrects the position in the transport direction of the medium, based on the correction data input to the control unit. As a result, a position shift of the image with respect to the plurality of through holes can be corrected uniformly, in the transport direction.

A liquid ejecting device according to a tenth aspect is the liquid ejecting device according to any one of the first to ninth aspects, wherein the hole forming unit forms the through hole in the medium, in a state in which the liquid ejected from the ejecting unit is undried in the medium.

According to the present aspect, compared to a configuration in which after the hole forming unit waits for the liquid to be dried, and the plurality of through holes are formed in the medium, a time required for the plurality of through holes to be formed in the medium after the liquid is ejected from the ejecting unit is shortened, so it is possible to increase throughput of image formation on the medium in the liquid ejecting device.

A liquid ejecting device according to an eleventh aspect is the liquid ejecting device according to any one of the first to tenth aspects, that includes an inspection unit configured to inspect a state of the ejecting unit, wherein the control unit causes the inspection unit to inspect a state of the ejecting unit, in a time in which the ejecting unit faces the second region of the medium.

According to the present aspect, compared to a configuration in which the image is formed in the second region, a total time required for image forming processing to form the image on the medium and inspection processing of the state of the ejecting unit by the inspection unit is shortened, as a result, throughput of image formation on the medium in the liquid ejecting device can be increased.

A control method for a liquid ejecting device according to a twelfth aspect is a control method for a liquid ejecting device that includes an ejecting unit for ejecting liquid onto a medium transported by a transport unit to form an image, a hole forming unit for forming a plurality of through holes arranged in a width direction intersecting a transport direction of the medium, in the medium onto which the liquid was ejected from the ejecting unit, and a control unit for controlling an ejection amount of the liquid per unit area from the ejecting unit based on image data, the control method including a step of dividing, when the plurality of through holes are formed in the medium, a region in the medium in which an image is formed based on the image data into a first region not including the plurality of through holes, and a second region including the plurality of through holes, and a step of controlling an ejection amount of the liquid from the ejecting unit, so that a second ejection amount per unit area when an image is formed in the second region is less than a first ejection amount per unit area when an image is formed in the first region.

According to the present aspect, an action effect similar to that in the liquid ejecting device according to the first aspect can be obtained.

A non-transitory computer-readable storage medium storing a control program for a liquid ejecting device according to a thirteenth aspect for solving the above-described problem is a storage medium storing a control program for a liquid ejecting device that includes an ejecting unit for ejecting liquid onto a medium transported by a transport unit to form an image, a hole forming unit for forming a plurality of through holes arranged in a width direction intersecting a transport direction of the medium, in the medium onto which the liquid was ejected from the ejecting unit, and a control unit for controlling an ejection amount of the liquid per unit area from the ejecting unit based on image data, the control program including a step of dividing, when the plurality of through holes are formed in the medium, a region in the medium in which an image is formed based on the image data into a first region not including the plurality of through holes, and a second region including the plurality of through holes, and a step of controlling an ejection amount of the liquid from the ejecting unit, so that a second ejection amount per unit area when an image is formed in the second region is less than a first ejection amount per unit area when an image is formed in the first region.

According to the present aspect, an action effect similar to that in the liquid ejecting device according to the first aspect can be obtained.

Exemplary Embodiment 1

Hereinafter, each configuration of Exemplary Embodiment 1, which is an example of a liquid ejecting device, a control method for a liquid ejecting device, and a control program for a liquid ejecting device according to the present disclosure, will be described in detail.

In FIG. 1, a recording system 1, which is an example of the liquid ejecting device, is illustrated. The recording system 1 is configured as an inkjet device for recording by ejecting ink Q, which is an example of liquid, onto a sheet P, which is an example of a medium.

In an X-Y-Z coordinate system illustrated in each figure, an X direction is a device width direction, a Y direction is a device depth direction, and a Z direction is a device height direction. The X direction, the Y direction, and the Z direction are orthogonal to each other. The Y direction is an example of a width direction of the sheet P.

When the recording system 1 is viewed from front, and left and right are distinguished from each other with respect to a center in the device width direction, left is referred to as a +X direction, and right is referred to as a −X direction. When front and back are distinguished from each other with respect to a center in the device depth direction, front is referred to as a +Y direction, and back is referred to as a −Y direction. When up and down are distinguished from each other with respect to a center in the device height direction, up is referred to as a +Z direction, and down is referred to as a −Z direction.

The recording system 1 has, in order in the +X direction, a recording unit 2, an intermediate unit 4, and a post-processing unit 30. Note that, in the recording system 1, the recording unit 2, the intermediate unit 4, and the post-processing unit 30 are mechanically and electrically coupled to each other. The intermediate unit 4 transports the sheet P fed from the recording unit 2 to the post-processing unit 30. In the following description, a transport direction of the sheet P is referred to as a T direction, and illustrated by an arrow T. Note that, the T direction is not constant, and an angle with respect to a horizontal direction varies depending on a position of the sheet P in a transport path K.

The recording system 1 is configured to perform post-processing described below on the sheet P on which information is recorded in an image forming unit 10 described below.

In addition, the recording system 1 may include a setting unit 13 and an operation unit 15 (FIG. 2) set and operated by a user, and a display unit 17 (FIG. 2) on which various types of information of the recording system 1 are displayed. In the present exemplary embodiment, as an example, the setting unit 13, the operation unit 15, and the display unit 17 are provided in the recording unit 2.

As an example, the setting unit 13, the operation unit 15, and the display unit 17 are constituted by one touch panel (not illustrated), and may be configured to be capable of performing operations of each unit of the recording system 1, and configured to be capable of setting various operating parameters. The operating parameters are displayed on the touch panel.

The display unit 17 may be configured to be capable of displaying a data table DT (FIG. 6) described later on the touch panel, and may be configured so that a second dimension L2b (FIG. 4) described later can be selected from the data table DT.

As an example, the setting unit 13 and the operation unit 15 are constituted by buttons displayed in different regions in the touch panel described above. Note that, the setting unit 13 and the operation unit 15 may be set and operated with the same buttons. In the setting unit 13, a second ejection amount d2 (FIG. 5) described below may be set by a button being operated by a user.

In the operation unit 15, the second dimension L2b described later, can be set by a button being operated by the user.

Figure 2:
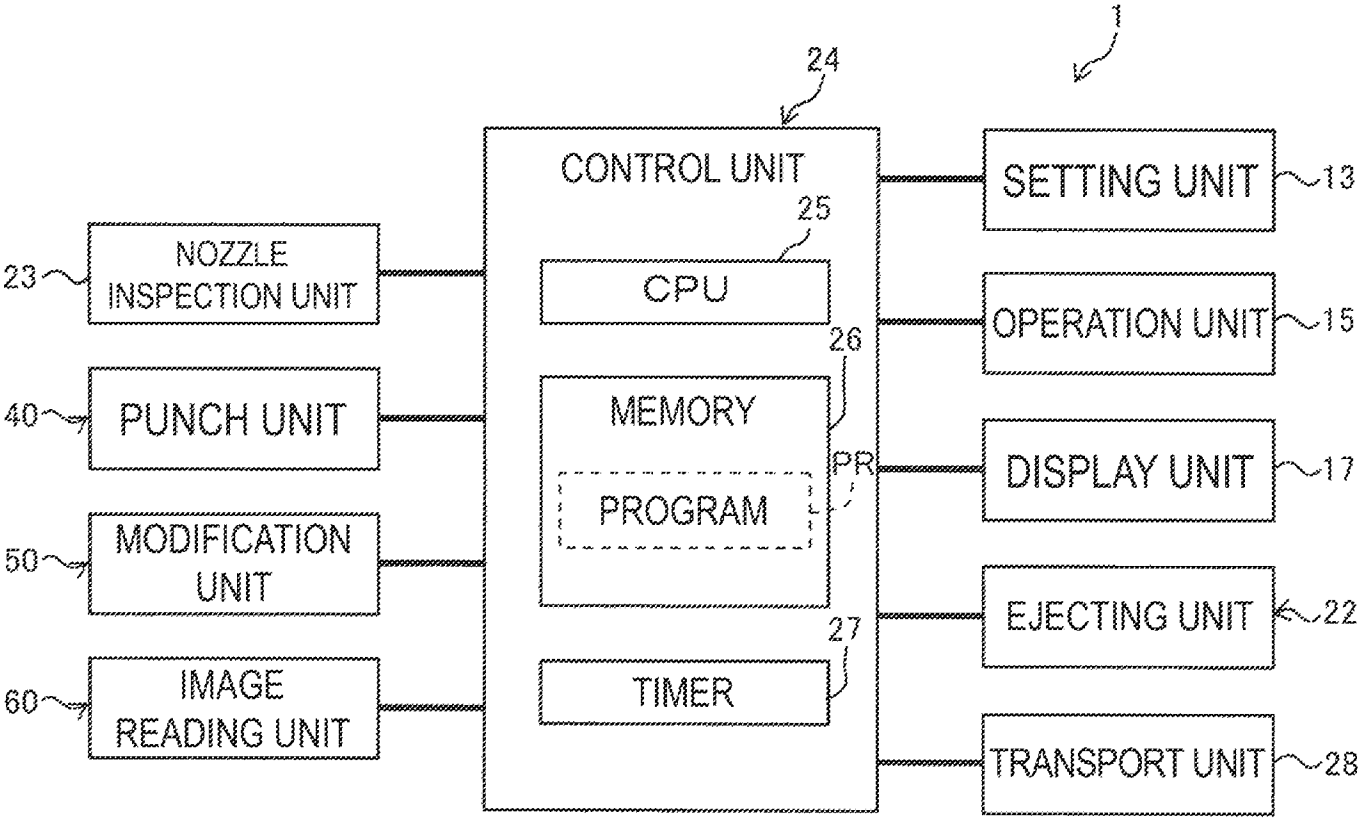
FIG. 2 is a block diagram of main units of the recording system according to Exemplary Embodiment 1.

The recording unit 2 records various types of information on the sheet P being transported. The sheet P is formed in a sheet shape. Further, the recording unit 2 includes the image forming unit 10, a scanner unit 12, a cassette accommodation unit 14, and a power supply 16. As an example, the image forming unit 10 is configured to include a recording head 20, a control unit 24, and a transport unit 28 (FIG. 2).

The recording head 20 is configured as a line head, as an example. Further, the recording head 20 includes an ejecting unit 22 including a plurality of nozzles (not illustrated).

The ejecting unit 22 forms an image by ejecting the ink Q onto the sheet P being transported. As an example, the ejecting unit 22 may include a nozzle inspection unit 23 (FIG. 2).

The nozzle inspection unit 23 is an example of an inspection unit for inspecting a state of the ejecting unit 22. Specifically, when the ink Q is ejected from the ejecting unit 22, the nozzle inspection unit 23 inspects a state of the nozzle, based on a non-ejection waveform that is a fine vibration waveform obtained by residual vibration inside a pressure chamber (not illustrated). The state of the nozzle means, for example, a state of change in viscosity of the ink Q inside the nozzle. In other words, in the inspection of the state of the nozzle, a clogging state of the ink Q inside the nozzle is inspected. Also, as the state of the nozzle, a state of whether paper powder such as the sheet P adheres thereto or not may be inspected.

As illustrated in FIG. 2, the control unit 24 includes a CPU (Central Processing Unit) 25 that functions as a computer, a memory 26, a timer 27 that can count a time or a time of day based on each time point, and a storage (not illustrated). Furthermore, the control unit 24 controls various operations in each unit of the recording system 1. Control by the control unit 24 includes control of operation of the punch unit 40 described below. Furthermore, based on image data DG (FIG. 7) of an image G, the control unit 24 controls an ejection amount d (litter/square meter) of the ink Q per unit area of the sheet P in the ejecting unit 22. Examples of the ejection amount d include a first ejection amount d1 and a second ejection amount d2 (FIG. 5) described below.

Various types of data including a program PR executed by the CPU 25 are stored in the memory 26. In other words, the memory 26 is an example of a recording medium in which the computer readable program PR is stored. Other examples of the recording medium include a CD (Compact Disc), a DVD (Digital Versatile Disc), a Blu-ray disk, a USB (Universal Serial Bus) memory, and the like. In addition, in a part of the memory 26, the program PR can be decompressed.

The program PR is a program for causing the CPU 25 to perform each step described below in the recording system 1.

Further, the memory 26 is an example of a storage unit, and stores the data table DT (FIG. 6).

The transport unit 28 is provided throughout the recording system 1, and transports the sheet P from a transport path 19 (FIG. 1) to the transport path K (FIG. 1) described below. Further, the transport unit 28 is configured to include a plurality of roller pairs including a first roller pair 54 and a second roller pair 57 (FIG. 3) described later, and a plurality of motors (not illustrated) that rotationally drive the plurality of roller pairs. Transport operation of the sheet P by the transport unit 28 is controlled by the control unit 24.

As illustrated in FIG. 1, the scanner unit 12 reads information of an original document (not illustrated). For image data of the original document read by the scanner unit 12, image analysis is possible in the control unit 24. In this image analysis, a through hole A (FIG. 4) described below can be identified.

The cassette accommodation unit 14 has a plurality of accommodation cassettes 18 for accommodating the plurality of sheets P. The image forming unit 10 and the cassette accommodation unit 14 form the transport path 19 through which the sheet P is transported. In the transport path 19, the sheet P is transported from the accommodation cassette 18 to a recording region of the recording head 20, and is further transported from the recording region through the intermediate unit 4 to the post-processing unit 30.

The post-processing unit 30 is an example of a post-processing device, and includes a housing 32, the punch unit 40, a modification unit 50, an image reading unit 60, and a staple unit 62. The transport path K is formed inside the housing 32. The sheet P received from the intermediate unit 4 is transported along the transport path K, and discharged to a discharge tray 33. In addition, the post-processing unit 30 performs post-processing for the sheet P. In the present exemplary embodiment, examples of the post-processing include punching processing for forming the through hole A (FIG. 4) in the sheet P in the punch unit 40, and staple processing for bundling the required number of sheets P in the staple unit 62.

The punch unit 40 is located downstream a sheet sensor 52 described below and upstream the staple unit 62, in the T direction of the transport path K. In addition, as an example, the punch unit 40 is provided in a lower unit 34, which is a site located in the −Z direction with respect to a center in the Z direction of the housing 32. Note that, a site that is a part of the transport path K and faces the punch unit 40 is along the X direction, as an example.

Figure 3:
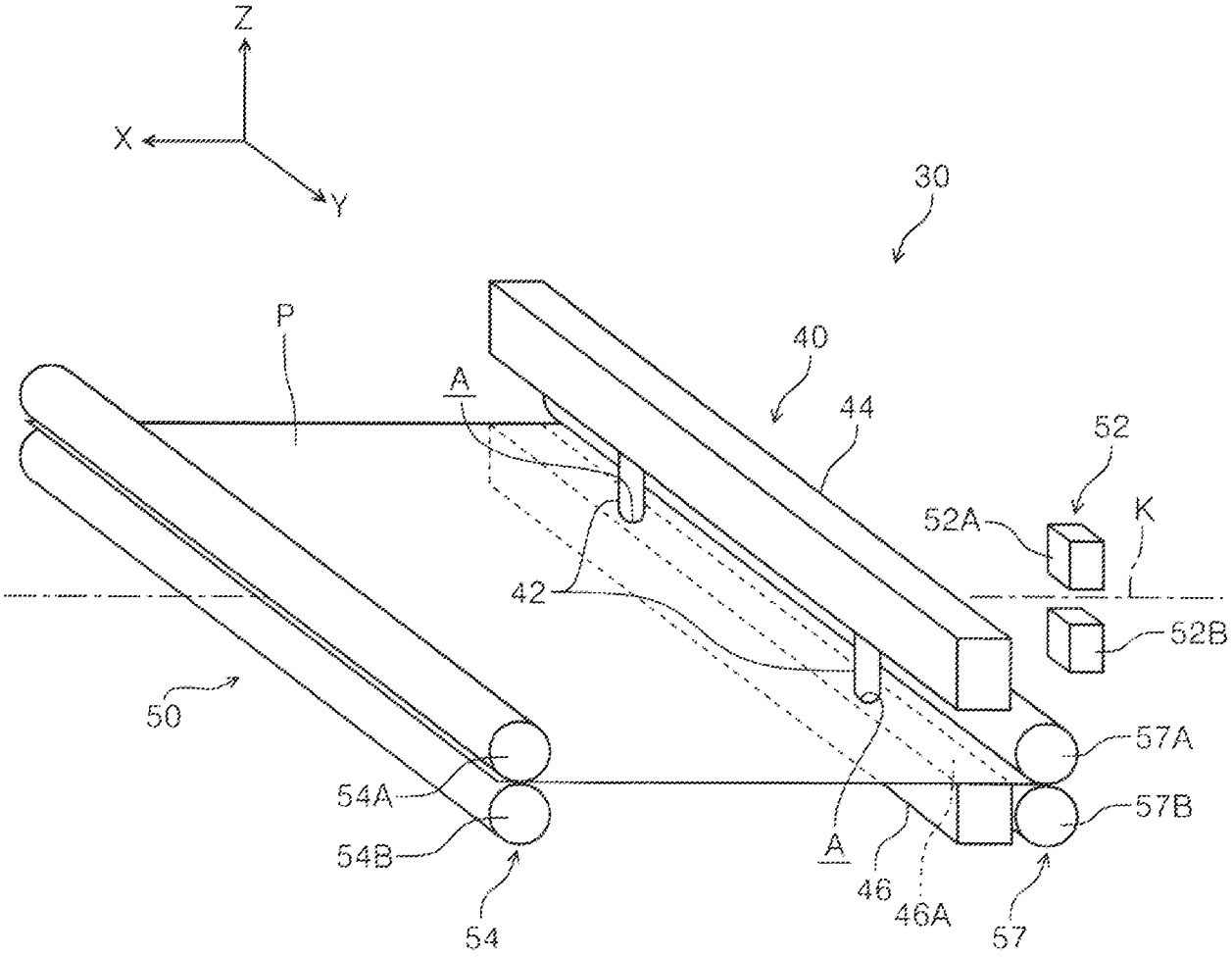
FIG. 3 is a perspective view illustrating a punch unit and a modification unit according to Exemplary Embodiment 1.

As illustrated in FIG. 3, the punch unit 40 is an example of a hole forming unit, and includes a punch 42, a support portion 44 that supports the punch 42, and a stand 46 on which the sheet P is placed.

The punch 42 is formed in a cylindrical shape having a central axis along the Z direction. A blade portion (not illustrated) is formed at an end portion in the −Z direction of the punch 42. In addition, two number of the punches 42 are provided as an example. The two punches 42 are arranged at intervals in the Y direction.

The support portion 44 is disposed in the +Z direction with respect to the transport path K, and supports the two punches 42 to be expandable and contractible in the Z direction. A motor (not illustrated) is provided in the support portion 44. The motor drives the two punches 42 in the Z direction.

The stand 46 is disposed in the −Z direction with respect to the transport path K. The stand 46 has an upper surface 46A on which a part of the sheet P is placed. Furthermore, a hole portion (not illustrated) is formed in the stand 46. A size and a depth of the hole portion are set to a size and a depth such that the two punch 42 penetrating the sheet P can enter therethrough, respectively. In a state in which a part of the sheet P is placed on the upper surface 46A, the two punches 42 penetrate respective parts of the sheet P while being moved in the −Z direction, thereby forming the two through holes A in the sheet P.

In this way, the punch unit 40 forms the two through holes A arranged in the Y direction that intersects with the T direction of the sheet P, in the sheet P onto which the ink Q is ejected from the ejecting unit 22. Specifically, the punch unit 40 may form the two through holes A in the sheet P, while the ink Q ejected from the ejecting unit 22 onto the sheet P is undried. In other words, the control unit 24 causes the transport unit 28 to transport the sheet P, so that the through hole A is formed in the sheet P, while the ink Q ejected from the ejecting unit 22 onto the sheet P is undried.

The state in which the ink Q is undried means a state in which a moisture content [mass %] of the sheet P after the image G is formed is not less than a moisture content [mass %] of the sheet P before the image G is formed. Note that, in the present exemplary embodiment, the ink Q is in the undried state, as an example, when a time from when the ejecting unit 22 starts ejecting the ink Q to when the sheet P faces the punch unit 40 is within 6 [seconds].

The modification unit 50 may be provided in the post-processing unit 30 (FIG. 1). In addition, the modification unit 50 may be configured to be capable of modifying a position in the T direction of the sheet P transported to the punch unit 40. Specifically, the modification unit 50 includes, as an example, the sheet sensor 52, the first roller pair 54, and the second roller pair 57.

The sheet sensor 52 is provided upstream the second roller pair 57 in the T direction. The sheet sensor 52 includes, as an example, an emission unit 52A located in the +Z direction with respect to the transport path K, and a light receiving unit 52B located in the −Z direction with respect to the transport path K. Then, the sheet sensor 52 detects a time of passage of the sheet P at the sheet sensor 52, by determining whether light from the emission unit 52A is received by the light receiving unit 52B or not.

The first roller pair 54 is located downstream the punch unit 40 in the T direction. Further, the first roller pair 54 has a roller 54A and a roller 54B with a direction of a central axis along the Y direction. The roller 54A and the roller 54B are driving rollers, and are rotationally driven by a motor (not illustrated). The roller 54A and the roller 54B transport the sheet P by sandwiching the sheet P in the Z direction while being rotated.

The second roller pair 57 is located downstream the sheet sensor 52 and upstream the punch unit 40, in the T direction. Further, the second roller pair 57 has a roller 57A and a roller 57B with a direction of a central axis along the Y direction.

The roller 57A and the roller 57B are driven rollers that sandwich the sheet P in the Z direction, and are rotated as the sheet P moves.

In the direction T, a position of the first roller pair 54 and a position of the second roller pair 57 are determined so that the first roller pair 54 sandwiches one end portion of the sheet P in the +T direction, and the second roller pair 57 sandwiches another end portion of the sheet P in the −T direction. As a result, in a state where the sheet P is subjected to tension between the first roller pair 54 and the second roller pair 57, the through hole A is formed by the punch unit 40. In addition, a tip position of the sheet P in the T direction can be modified by rotating and stopping the first roller pair 54 and the second roller pair 57.

As illustrated in FIG. 1, the image reading unit 60 is disposed downstream the first roller pair 54 in the T direction. In addition, the image reading unit 60 is configured as a contact image sensor module (CISM) as an example. The image reading unit 60 is capable of reading respective images on both sides of the sheet P. Image data read by the image reading unit 60 is sent to the control unit 24. The control unit 24 detects a position of an image and respective positions of the two through holes A in the sheet P by performing image analysis based on the obtained image data. In addition, the control unit 24 acquires a correction data amount for a position of the sheet P facing the punch unit 40, by determining a difference between respective preset positions of the two through holes A, and the respective positions of the two through holes A obtained by the image analysis.

The staple unit 62 forms a sheet bundle M by driving a staple (not illustrated) into the plurality of sheets P stacked at an end of the transport path K.

Figure 4:
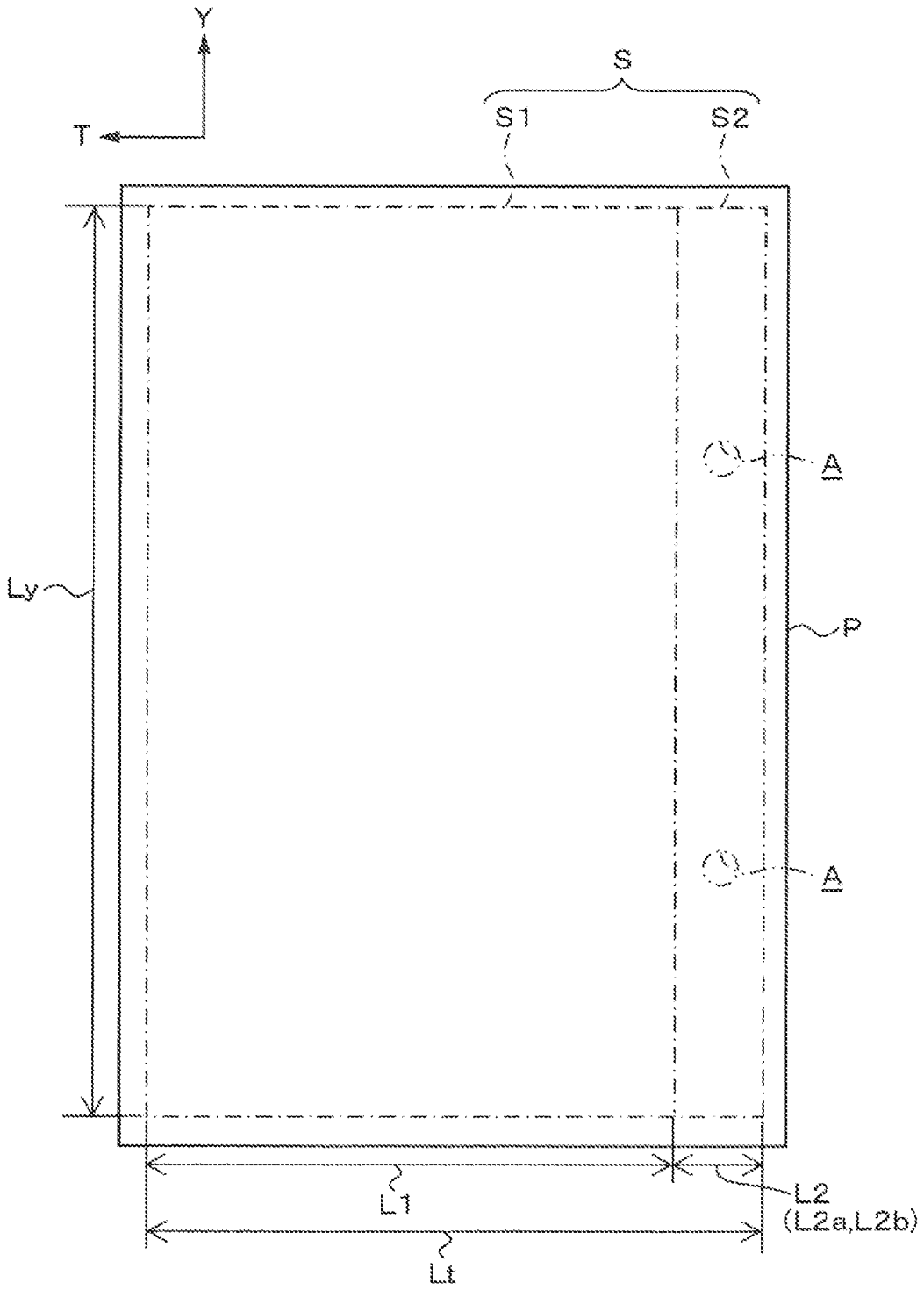
FIG. 4 is a plan view illustrating a region in which an image can be formed in a sheet used in the recording system according to Exemplary Embodiment 1.

As illustrated in FIG. 4, in the sheet P, a region in which the image G (FIG. 7) is formed based on the image data DG is referred to as a region S. The region S is a virtual region, and when viewed from the Z direction, is set to a rectangular shape having a dimension in the Y direction greater than a dimension in the T direction. The dimension in the T direction of the region S is Lt (mm), and the dimension in the Y direction of the region S is Ly (mm). In the present exemplary embodiment, as an example, the region S is set by the control unit 24 (FIG. 2) as a region obtained by excluding an outer edge portion of the sheet P.

When the two through holes A are formed in the sheet P, the control unit 24 divides the region S into a first region S1 and a second region S2 in the T direction. Specifically, the control unit 24 divides the region S into the first region S1 and the second region S2 in the T direction, such that a dimension in the T direction of the second region S2 is set by the operation unit 15 (FIG. 2) or is set to a set dimension L2 [mm] stored in advance in the memory 26 (FIG. 2). As described above, the set dimension L2 is an example of a dimension in the T direction of the second region S2, and can be set by the operation unit 15.

The first region S1 is a region in which the image G (FIG. 7) is formed, and is a region that does not include the two through holes A. Further, the first region S1 is a region having a dimension L1 [mm] in the T direction of and the dimension Ly [mm] in the Y direction. L1=Lt−L2.

The second region S2 is a region that is aligned with the first region S1 in the T direction and includes the two through holes A. Note that, in the present exemplary embodiment, the second region S2 is located upstream the first region S1 in the T direction. Also, as described above, the second region S2 is a region having the dimension Ly in the Y direction, and the set dimension L2 of the dimension in the T direction. In other words, the second region S2 is a band-like region corresponding to an overall width in the Y direction of the image data DG.

In the control unit 24, the dimension Ly and the set dimension L2 are set in advance so that the dimension Ly of the second region S2 in the Y direction is a dimension greater than the set dimension L2 of the second region S2 in the T direction.

In the present exemplary embodiment, for the set dimension L2, a dimension stored in advance in the memory 26 of the control unit 24 is a first dimension L2a, and a dimension set by the operation unit 15 is a second dimension L2b, and the dimensions are distinguished from each other. Note that, as an example, the set dimension L2 is a dimension having a size obtained by adding an error ΔL [mm] (not illustrated) to a diameter of the through hole A, and is set such that an entirety of the two through holes A fit within the second region S2. The error ΔL is set based on an amount of position shift of the punch 42 (FIG. 3) assumed with respect to a position at which the through hole A is to be formed.

Figure 7:
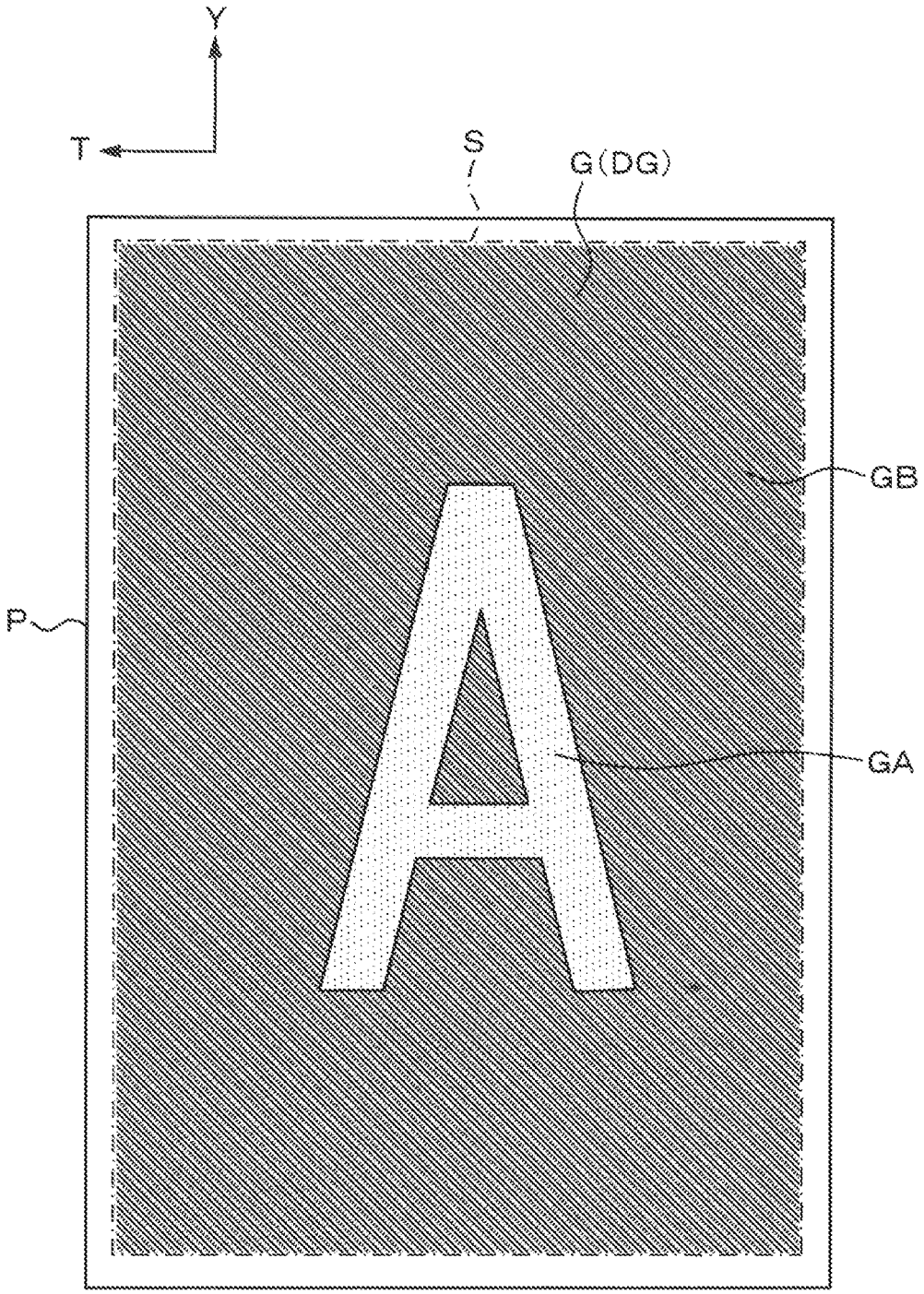
FIG. 7 is a plan view illustrating an example of image data for forming an image in the recording system according to Exemplary Embodiment 1.

As illustrated in FIG. 7, the image G based on the image data DG is formed in the entire region S, as an example. In addition, as an example, the image G is constituted by a main image portion GA and a background portion GB around the main image portion GA. As an example, the main image portion GA is constituted by an image of an alphabet A represented by a color other than black. As an example, the background portion GB is an image entirely filled in black. Note that, in FIG. 7, the background portion GB is not filled in black, but is indicated by diagonal lines.

Figure 5:
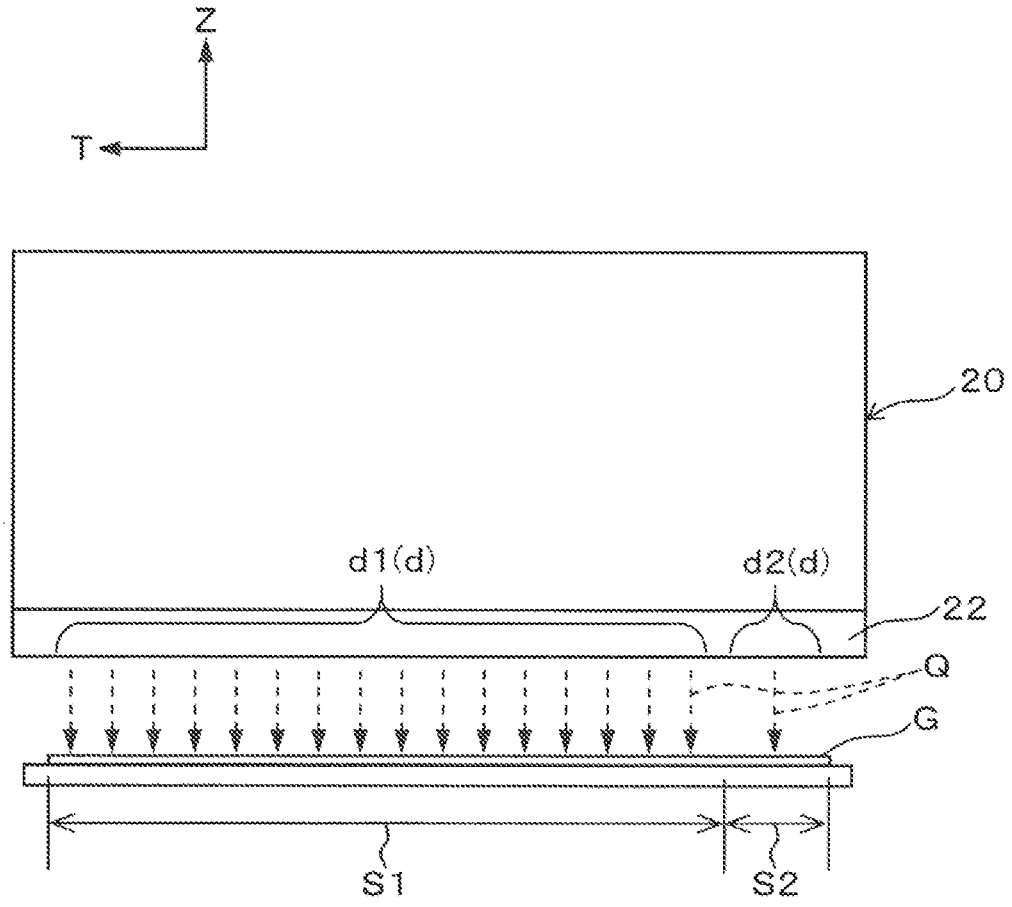
FIG. 5 is a schematic diagram illustrating a relationship between each region of the sheet used in the recording system according to Exemplary Embodiment 1 and each ejection amount from an ejecting unit.

As illustrated in FIG. 5, when the image G is formed in the first region S1, the ejection amount d per unit area of the ink Q ejected from the ejecting unit 22 toward the sheet P is the first ejection amount d1. Additionally, when the image G is formed in the second region S2, the ejection amount d per unit area of the ink Q ejected from the ejecting unit 22 toward the sheet P is the second ejection amount d2.

Here, the control unit 24 (FIG. 2) controls the ejection amount d of the ink Q in the ejecting unit 22 such that the second ejection amount d2 is less than the first ejection amount d1. In addition, the control unit 24 controls ejection of the ink Q from the ejecting unit 22 such that the ejection amount d in the second region S2 is the second ejection amount d2 set by the setting unit 13 (FIG. 2). Note that, in the present exemplary embodiment, the second ejection amount d2 includes zero. Further, the control for reducing the ejection amount d in the second S2 may be performed when the ejection amount d dependent on the image G is greater than or equal to a threshold value before the control, or may be performed uniformly regardless of the ejection amount d.

As illustrated in FIG. 6, the memory 26 (FIG. 2) may store sheet thickness data, which is a thickness of the sheet P, and data of the first ejection amount d1 and the second ejection amount d2 corresponding to the sheet thickness data in the data table DT.

In the data table DT, d1=da and d2=db are set when the sheet thickness [mm] is T1. When the sheet thickness [mm] is T2, d1=dc and d2=dd are set. When the sheet thickness [mm] is T3, d1=de and d2=df are set. Here, T1<T2<T3. Also, as an example, db<dd<df<da<dc<de.

Control by the control unit 24 will be described in further detail. Note that, for the recording system 1, reference is made to FIG. 1 to FIG. 5 for the configuration described above, and the description of the individual figure numbers is omitted.

The control unit 24 causes the ejecting unit 22 to eject the ink Q based on the image data DG in the region S to form the image G.

Figure 8:
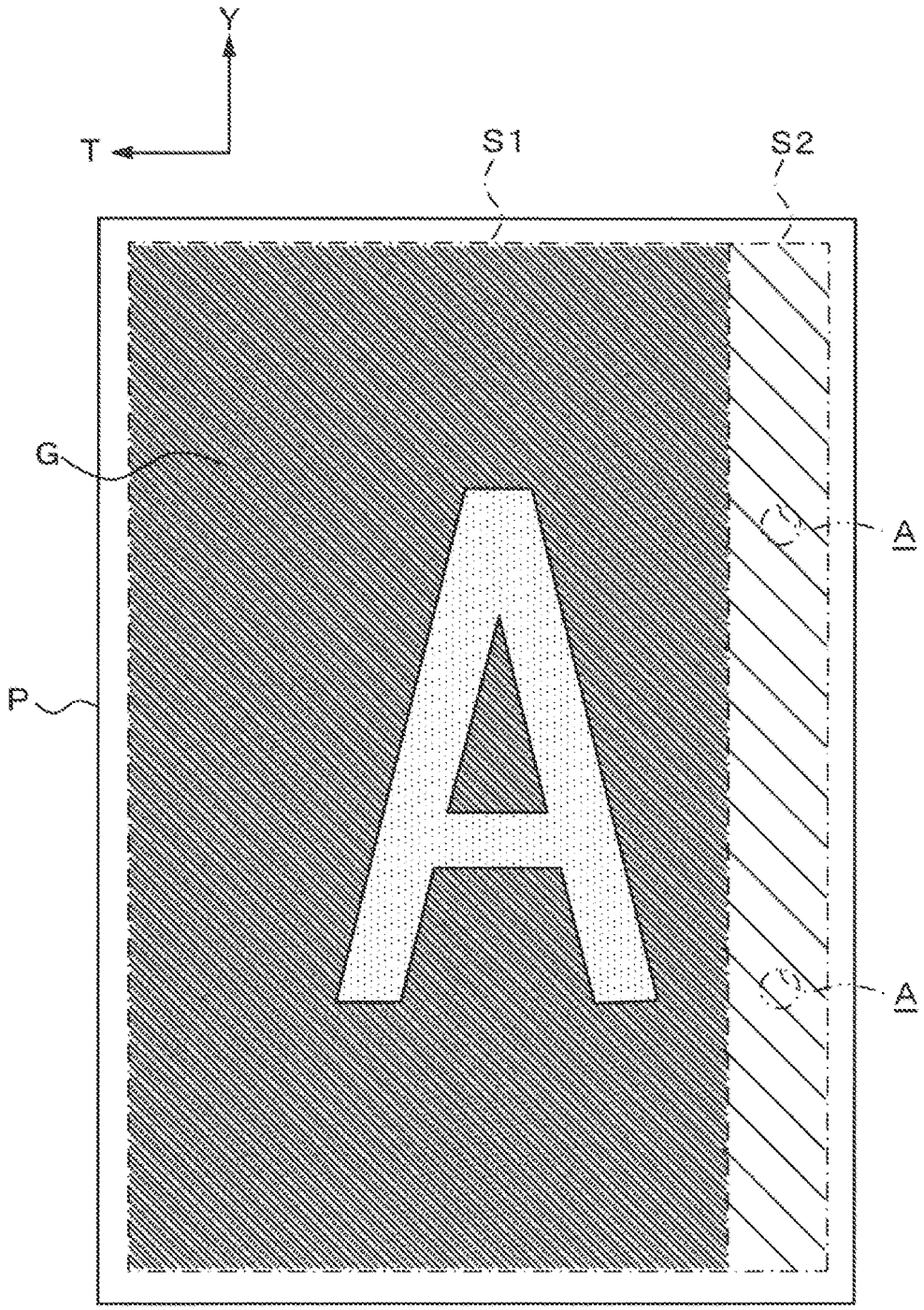
FIG. 8 is a plan view illustrating an image in a first region, an image in a second region, and virtual through holes, set in the recording system according to Exemplary Embodiment 1.

As illustrated in FIG. 8, as an example, in the sheet P after the image G is formed and before the through hole A is formed, second image density of a part of the image G corresponding to the second region S2 is lower than first image density of a part of the image G corresponding to the first region S1. This is because the second ejection amount d2 is less than the first ejection amount. Note that, the image density is correlated with image density.

In addition, the control unit 24 causes the nozzle inspection unit 23 to inspect a state of the ejecting unit 22, as long as the ink Q is not ejected in the second region S2, at a time when the ejecting unit 22 faces the second region S2 of the sheet P. As described above, the state of the ejecting unit 22 is a clogging state of the ink Q inside the nozzle. Note that, when duty of the ink Q ejected in the second region S2 is lower than preset duty, the state of the ejecting unit 22 can be inspected by the nozzle inspection unit 23.

Next, description is made of effects of the recording system 1 according to Exemplary Embodiment 1. Note that, for each unit constituting the recording system 1, each image, and each region, reference is made to FIG. 1 to FIG. 8, and the description of the individual figure numbers is omitted.

Figure 9:
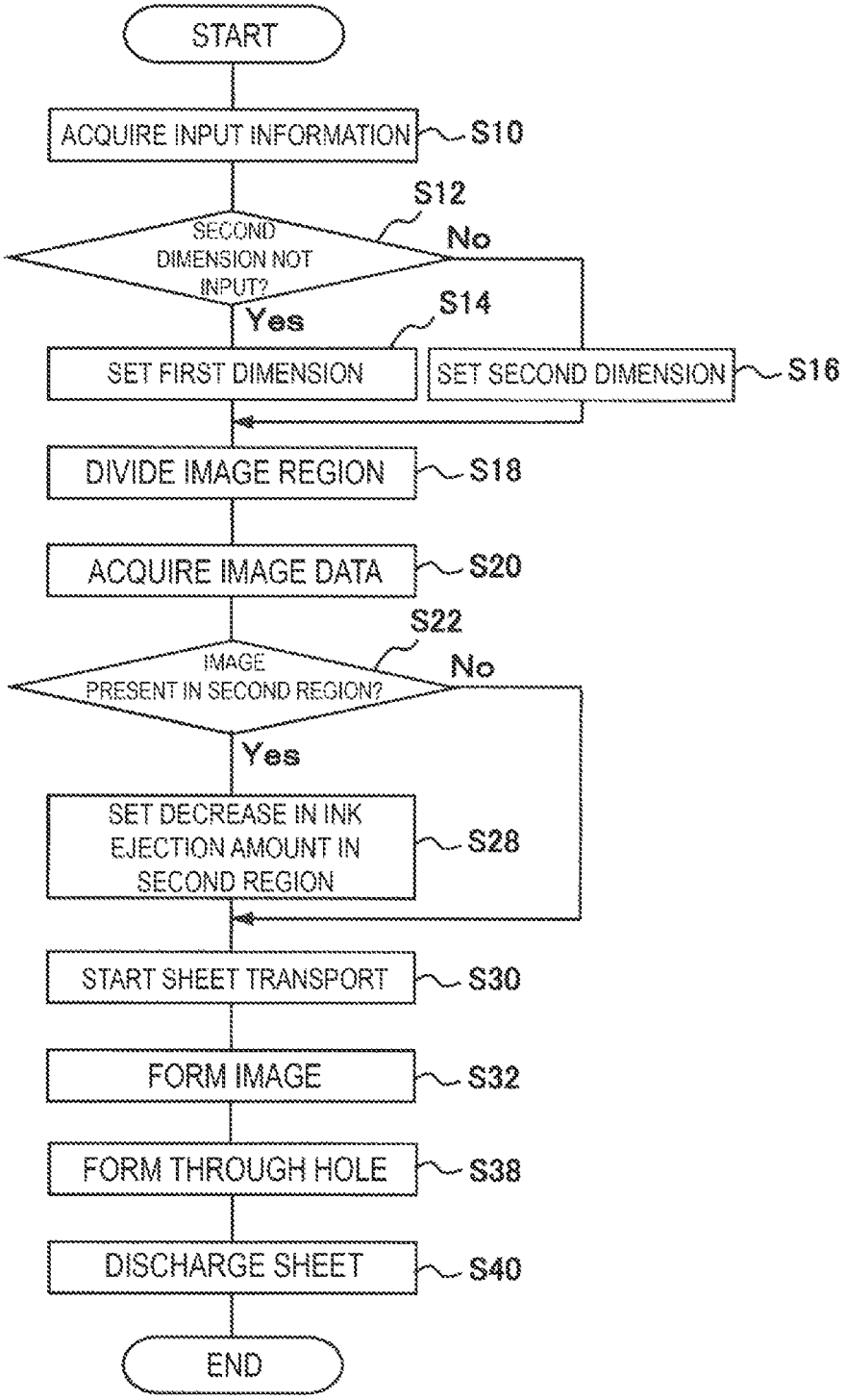
FIG. 9 is a flowchart illustrating a flow of respective processes performed in the recording system according to Exemplary Embodiment 1.

FIG. 9 is a flowchart illustrating a flow of respective processes from acquisition of information from the operation unit 15 by the control unit 24 until the sheet P is discharged. Each of the processes illustrated in FIG. 9 is performed by the CPU 25 that reads the program PR from the memory 26, and decompresses and executes the program PR.

In step S10, the CPU 25 acquires information of the second dimension L2b from the operation unit 15. Then, the processing proceeds to step S12.

In step S12, the CPU 25 proceeds to step S14 when the information of the second dimension L2b is not input in the operation unit 15, that is, when the second dimension L2b is not set (S12: Yes). When the information of the second dimension L2b is input in the operation unit 15 (S12: No), the processing proceeds to step S16.

In step S14, the CPU 25 sets the stored first dimension L2a as the set dimension L2 in the T direction of the second region S2. Then, the processing proceeds to step S18.

In step S16, the CPU 25 sets the second dimension L2b input in the operation unit 15 as the set dimension L2. Then, the processing proceeds to step S18.

In step S18, the CPU 25 divides the region S into the first region S1 and the second region S2 such that a dimension in the T direction of the second region S2 is the set dimension L2 (one example of a division step). Then, the processing proceeds to step S20.

In step S20, the CPU 25 acquires the image data DG. The acquisition of the image data DG may be acquisition from an external device different from the recording system 1, as well as acquisition by reading an original document in the scanner unit 12. Then, the processing proceeds to step S22.

In step S22, the CPU 25 applies image data DG to region S. That is, the CPU 25 checks which part of the image data DG is located at which part of the region S. When a part of the image data DG is present in the second region S2 (S22: Yes), the processing proceeds to step S28. When a part of the image data DG is not present in the second region S2 (S22: No), the processing proceeds to step S30.

In step S28, the CPU 25 controls an ejection amount of the ink Q in the ejecting unit 22 such that the second eject amount d2 in the second region S2 is less than the first eject amount d1 in the first region S1 (one example of an ejection amount control step). In other words, the second ejection amount d2 is set to a value less than the first ejection amount d1. Then, the processing proceeds to step S30.

In step S30, the CPU 25 starts transport of the sheet P from the cassette accommodation unit 14 by starting operation of the transport unit 28. Then, the processing proceeds to step S32.

In step S32, the CPU 25 causes the ink Q to be ejected with the first ejection amount d1 in the first region S1 from the ejecting unit 22, and causes the ink Q to be ejected with the second ejection amount d2 in the second region S2. As a result, image density of the image G in the second region S2 is reduced, compared to image density of the image G in the first region S1. Then, the processing proceeds to step S38.

In step S38, the CPU 25 operates the punch unit 40 with the transport unit 28 once stopped to form the two through holes A in the second region S2 of the sheet P. Then, the processing proceeds to step S40.

In step S40, the CPU 25 operates the transport unit 28 to transport the sheet P, and discharge the sheet P to the discharge tray 33. Then, the program PR is ended. Note that, when at least one of the image G and the through hole A is formed in another sheet P, the program PR is executed again.

As described above, according to the recording system 1, in the first region S1 of the sheet P, a part of the image G is formed by ejecting the ink Q from the ejecting unit 22 with the first ejection amount d1 based on the image data DG.

On the other hand, in the second region S2 of the sheet P, the ejection amount d per unit area of the ink Q is set to the second ejection amount d2, to be less than the first ejection amount d1 in the first region S1. That is, in the second region S2, the image density of the image G formed in the second region S2 is lower than the image density of the image G formed in the first region S1. As a result, when the through hole A is formed in the second region S2, a difference in image density between a missing part of the image G due to the through hole A and the image G in the second region S2 is less compared to a case where the through hole A is formed in the first region S1, therefore, a position shift of the two through holes can be prevented from being conspicuous.

Furthermore, according to the recording system 1, when the second ejection amount d2 is not set to zero, the image data DG corresponding to the second region S2 of the image data DG remains even with low image density, and thus the image G with little loss can be obtained.

Similar effects can also be obtained in the control method for the recording system 1 and the control program for the recording system 1.

Note that, when the ink Q is ejected onto the sheet P and the sheet P is inflated, elasticity of the sheet P decreases, and the through hole A is formed, shear failure tends to occur. When shear failure occurs, there is a possibility that the through hole A may be misshapen rather than being formed in a circular shape, and a punch scrap is sandwiched between the punch unit 42 and the stand 46 without being completely separated from the sheet P, and the punch unit 42 is caught. Here, in the recording system 1, only a small amount of the ink Q is ejected onto and near the through hole A, so shape failure of the through hole A and jam of the punch unit 42 are easily avoided.

According to the recording system 1, the second region S2 is set entirely along the Y direction, so compared to a configuration in which the second region S2 is set partially along the Y direction, a process for reducing a shift between a position of the image G in the second region S2 and a position of the through hole A need not be performed.

Additionally, according to the recording system 1, the second ejection amount d2 can be freely set by the setting unit 13, and thus the image G in the second region S2 along an intention of a user can be obtained.

Additionally, according to the recording system 1, the thickness data of the sheet P and the data of the second ejection amount d2 are stored in the data table DT, thus, when the thickness of the sheet P used in the recording system 1 is modified, the appropriate second ejection amount d2 of the ink Q can be ejected from the ejecting unit 22 in accordance with the thickness of the sheet P.

According to the recording system 1, the second region S2 is formed to be longer in the Y direction than in the T direction, even in a configuration in which a position shift in the Y direction with respect to a set position set in advance of the punch unit 40 is more remarkable than a position shift in the T direction with respect to the set position of the punch unit 40, therefore, when the two through holes A are formed, a position shift of the two through holes A can be prevented from being conspicuous.

Additionally, according to the recording system 1, the dimension in the T direction of the second region S2 can be freely set by the operation unit 15, and thus the image G in the first region S1 along an intention of the user can be obtained.

Furthermore, according to the recording system 1, compared to a configuration in which the punch unit 40 forms the two through holes A in the sheet P after waiting for the ink Q to be dried, a time required for the two through holes A to be formed in the sheet P after the ink Q is ejected from the ejecting unit 22 is shortened, throughput of image formation on the sheet P in the recording system 1 can be increased.

Exemplary Embodiment 2

Next, each configuration of Exemplary Embodiment 2, which is an example of the liquid ejecting device, the control method for the liquid ejecting device, and the control program for the liquid ejecting device according to the present disclosure will be described in detail. Note that, portions and methods common to those in Exemplary Embodiment 1 are denoted by the same reference signs, and descriptions thereof will be omitted.

Figure 10:
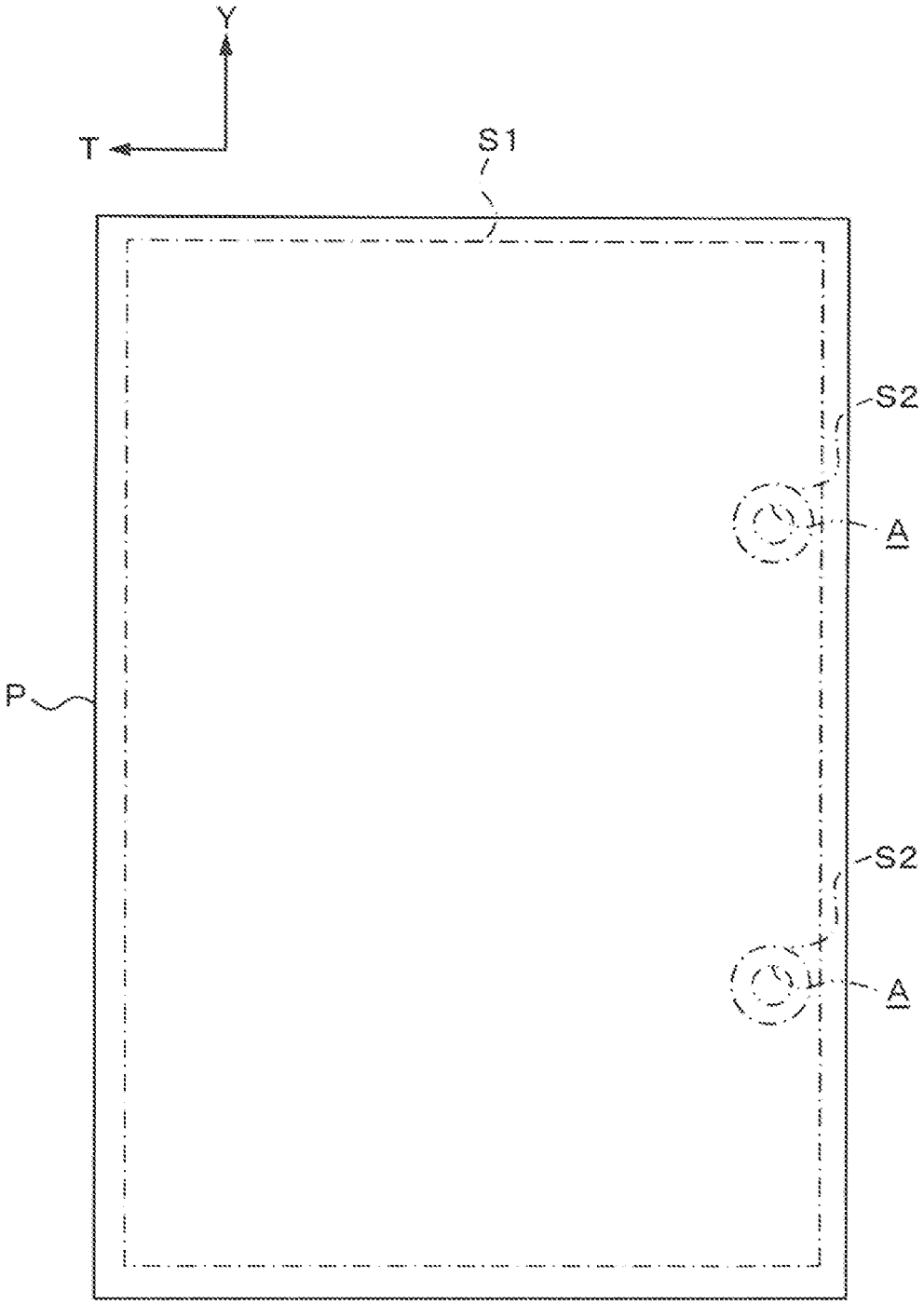
FIG. 10 is a plan view illustrating a first region, a second region, and through holes, set in a recording system according to Exemplary Embodiment 2.

As illustrated in FIG. 10, in the recording system 1 (FIG. 1) according to Exemplary Embodiment 2, the first region S1, which occupies a large part of a region of the sheet P in which an image can be formed, and the two second regions S2 located upstream in the T direction and inside the first region S1 are set.

The two second regions S2 are each set as a circular region, as an example. Further, the two second regions S2 are arranged at intervals in the Y direction. A diameter of the circle of the second region S2 is greater than a diameter of a circle of the through hole A. The through hole A is set inside the second region S2.

Figure 12:
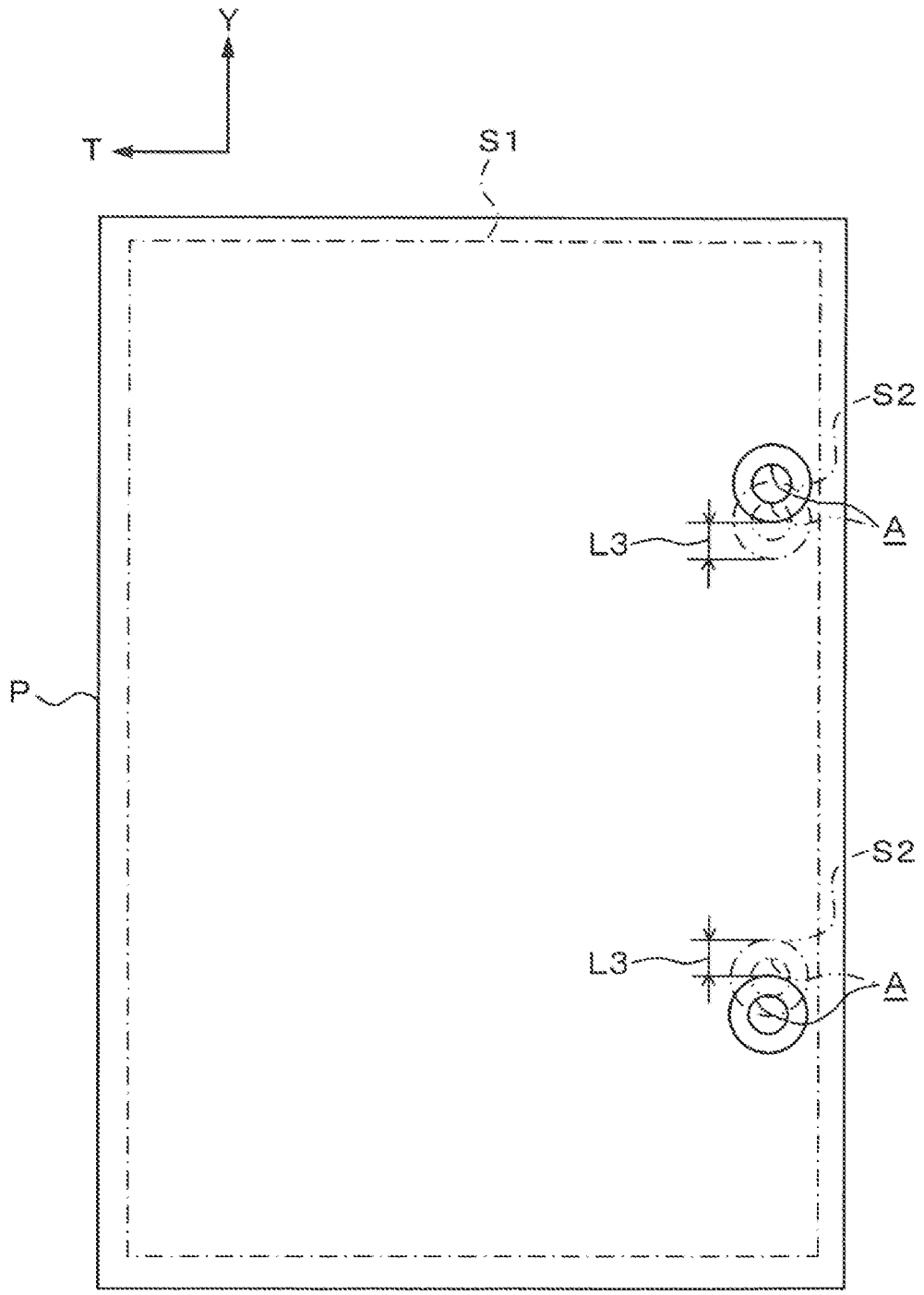
FIG. 12 is a plan view illustrating a state in which a position of the second region is corrected in a width direction in the recording system according to Exemplary Embodiment 2.

In FIG. 12, the preset first region S1 and second region S2 are each indicated by a dot-dash line, and the preset through hole A is indicated by a two-dot chain line.

Furthermore, the actual formed second region S2 and through hole A are each indicated by a solid line. The reason why an actual position of the through hole A is shifted from the preset position is that a position of the punch 42 (FIG. 3) is shifted in the Y direction from the set position due to an assembly error or the like.

As an example, it is assumed that the second region S2 and the through hole A in the +Y direction are shifted in the +Y direction by a length L3 [mm] from the respective set positions. It is assumed that the second region S2 and the through hole A in the −Y direction are shifted in the −Y direction by L3 [mm] from the respective set positions.

The operation unit 15 (FIG. 2) may be configured to be able to select whether the position of the second region S2 is shifted in the Y direction in the sheet P or not. Furthermore, the operation unit 15 may be configured to be able to set the length L3 [mm] for each of the through holes A as an amount of shift in the Y direction of the second region S2. The length L3 is sent to the control unit 24 as correction data.

The control unit 24 (FIG. 2) is configured to accept input of correction data for correcting the respective positions in the Y direction of the two second regions S2 for the respective through holes A, and correct the respective positions of the two second regions S2 in the Y direction based on the input correction data.

Figure 13:
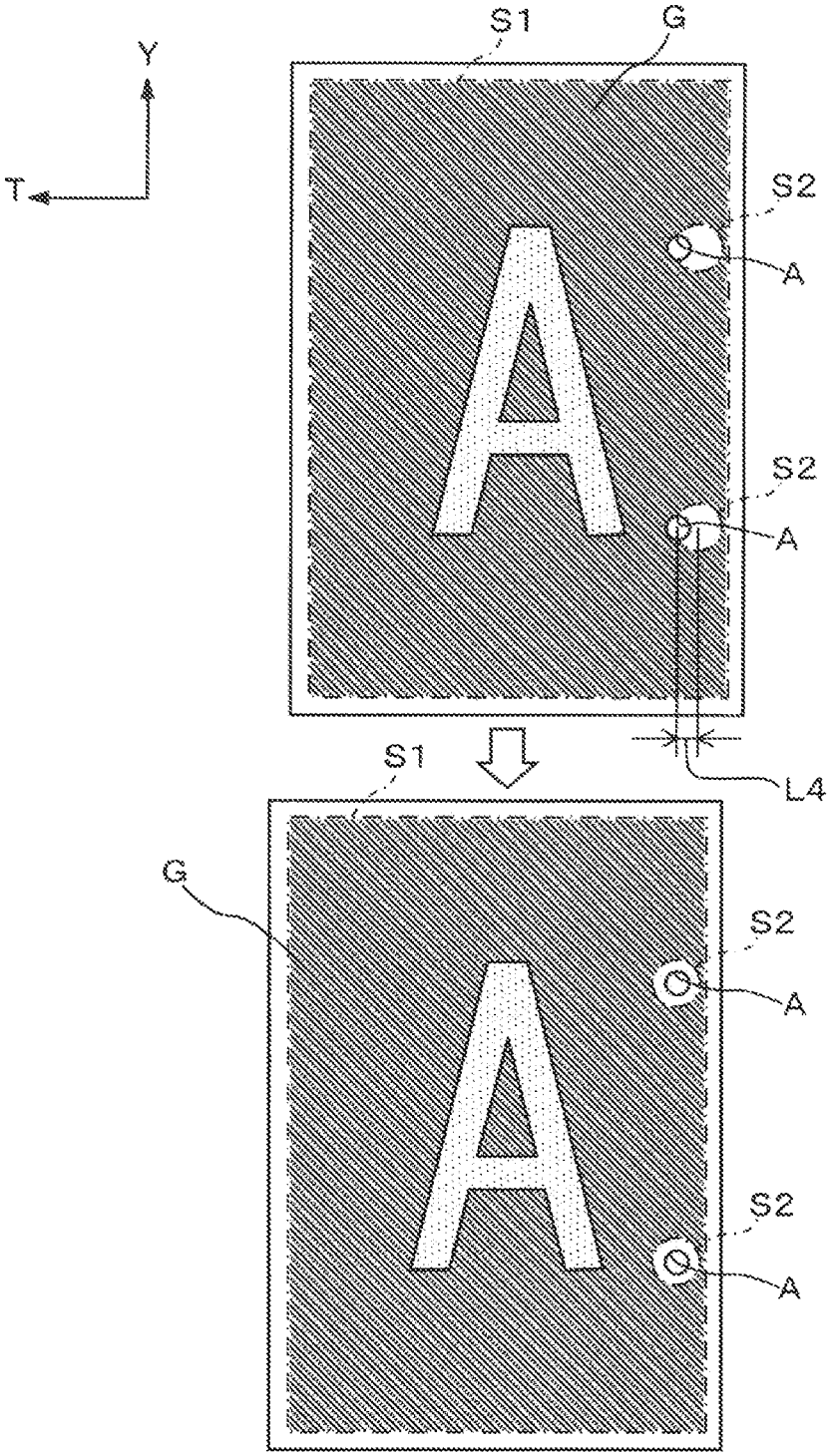
FIG. 13 is a plan view illustrating a state in which a position in a transport direction of a sheet in which the through hole is formed in the recording system according to Exemplary Embodiment 2.

As illustrated in FIG. 13 and FIG. 2, the control unit 24 is configured to accept input of transport correction data for correcting a position of the sheet P in the T direction, and may correct the position of the sheet P in the T direction by operating the modification unit 50 based on the input transport correction data. As an example, the transport correction data is data input from the operation unit 15 data, and is a data of a length L4 [mm], which is an amount of shift in the T direction. Note that, as the transport correction data, transport correction data determined from image analysis by the image reading unit 60 may be used, instead of the transport correction data input from the operation unit 15.

Specifically, the position of the sheet P in a state of facing the punch unit 40 is shifted downstream in the T direction by the length L4. In other words, the position of the sheet P is shifted so that an imaginary line that connects respective centers of the two through holes A is shifted by the length L4 in the T direction.

Note that, other configurations are the same as those in Exemplary Embodiment 1.

Figure 11:
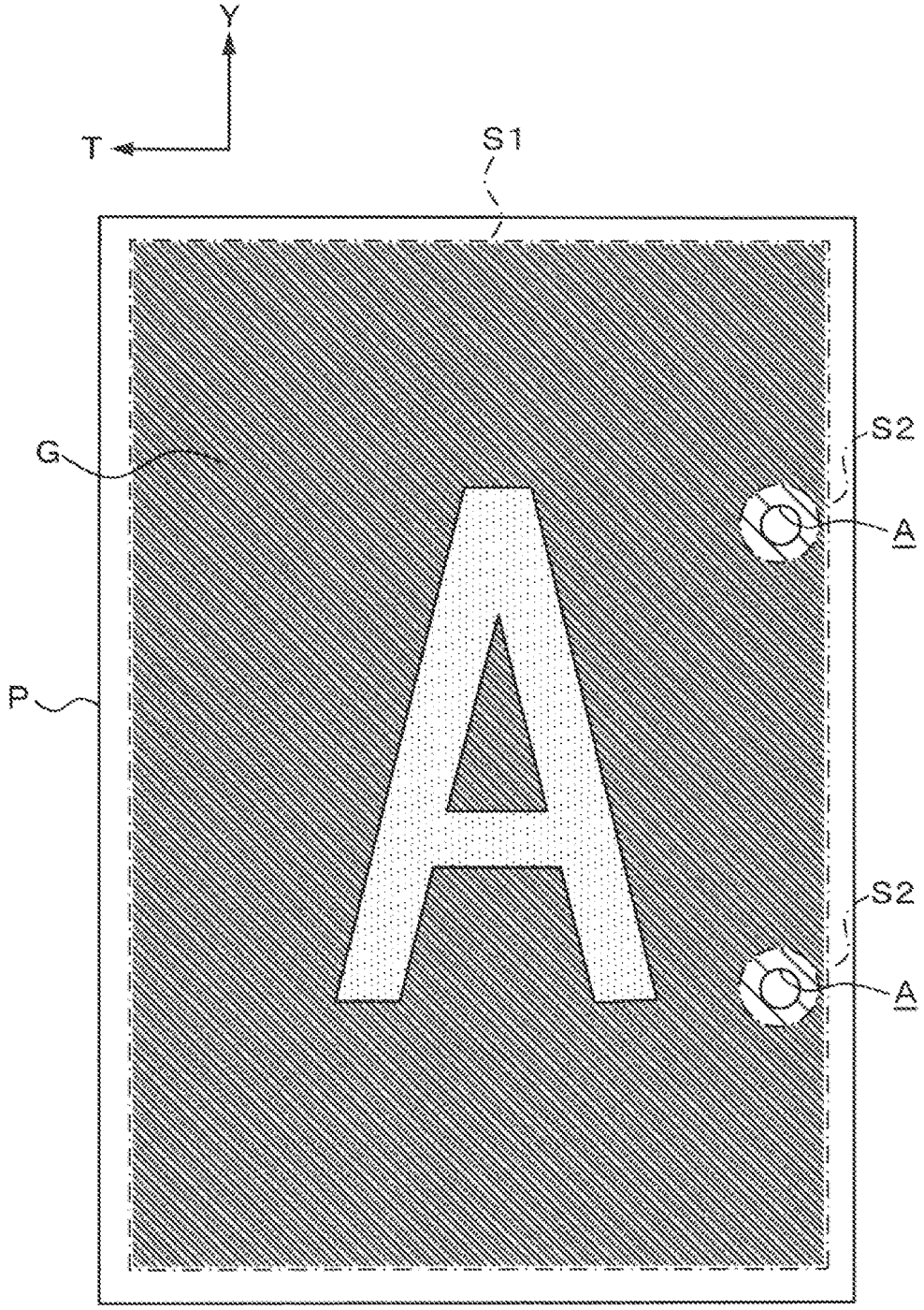
FIG. 11 is a plan view illustrating an image in the first region, an image in the second region, and the through holes, set in the recording system according to Exemplary Embodiment 2.

As illustrated in FIG. 11, the sheet P subjected to image forming processing and post-processing by the recording system 1 according to Exemplary Embodiment 2, second image density of the image G in the second region S2 is lower than first image density of the image G in the first region S1. Note that, in FIG. 11, a state in which the second image density in the second region S2 is lower than the first image density of the first region S1 is represented by increasing an interval between diagonal lines.

Next, description is made of effects of the recording system 1 according to Exemplary Embodiment 2. Note that, for each unit constituting the recording system 1, each image, and each region, reference is made to FIG. 1 to FIG. 13, and the description of the individual figure numbers is omitted.

Figure 14A:
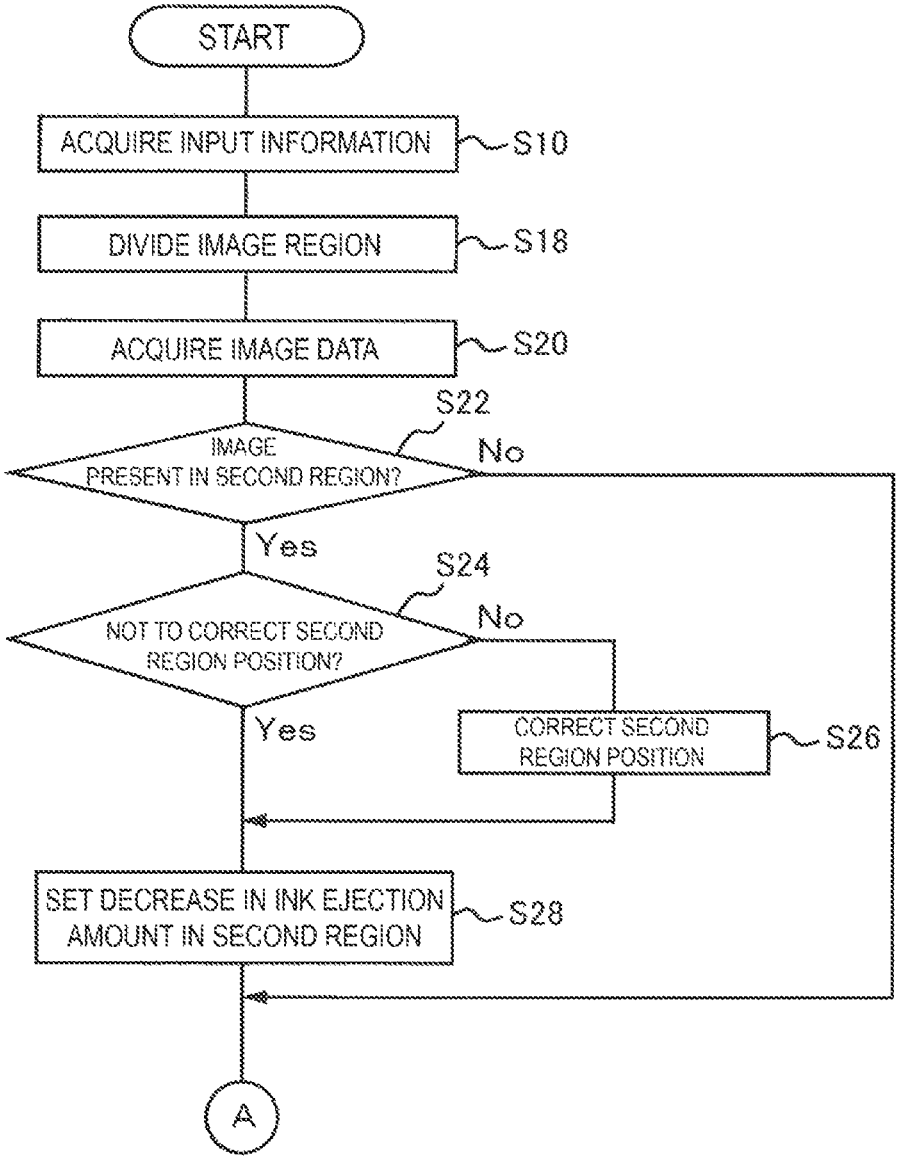
FIG. 14A is a first half of a flowchart illustrating a flow of respective processes performed in the recording system according to Exemplary Embodiment 2.
Figure 14B:
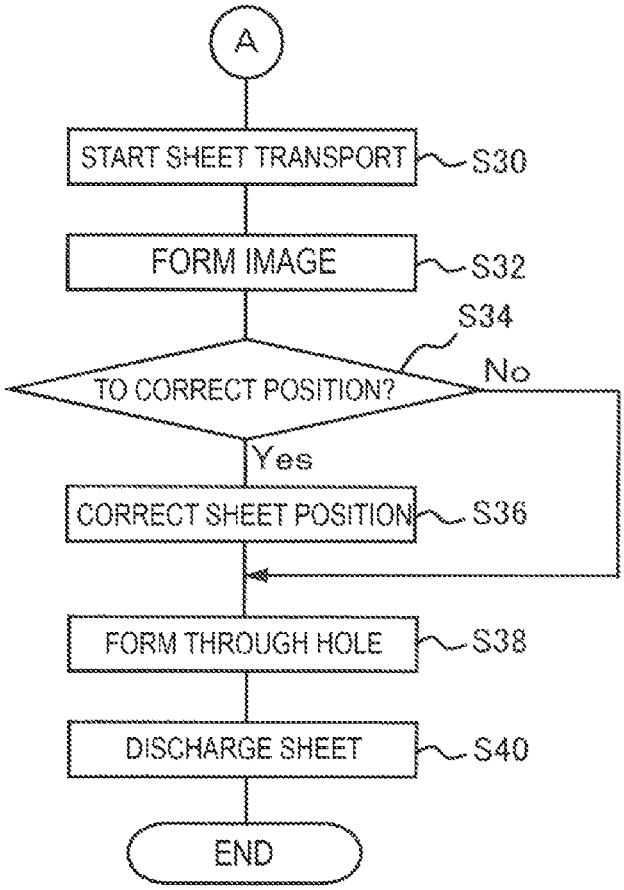
FIG. 14B is a second half of the flowchart illustrating the flow of the respective processes performed in the recording system according to Exemplary Embodiment 2.

FIG. 14A and FIG. 14B are each a flowchart illustrating a flow of respective processes from acquisition of information from the operation unit 15 by the control unit 24 until the sheet P is discharged. Each of the processes illustrated in FIG. 14A and FIG. 14B is performed by the CPU 25 that reads the program PR from the memory 26, and decompresses and executes the program PR. Note that, the same steps as those of Exemplary Embodiment 1 are denoted by the same reference signs as in Exemplary Embodiment 1, and descriptions thereof will be omitted.

After the process in step S10, the processing proceeds to step S18, and step S18 and step S20 are performed. Then, the processing proceeds to step S22.

In step S22, the CPU 25 applies image data DG to region S. That is, the CPU 25 checks which part of the image data DG is located at which part of the region S. When a part of the image data DG is present in the second region S2 (S22: Yes), the processing proceeds to step S24. When a part of the image data DG is not present in the second region S2 (S22: No), the processing proceeds to step S30.

In step S24, the CPU 25 determines whether to correct the position in the Y direction of the second region S2 based on the information of the operation unit 15 or not. In other words, when the correction for the position of the second region S2 in the Y direction is set by the operation unit 15, the CPU 25 determines to correct the position in the Y direction of the second region S2. On the other hand, when the correction for the position in the Y direction of the second region S2 is not set by the operation unit 15, the CPU 25 determines not to correct the position in the Y direction of the second region S2. When the position in the Y direction of the second region S2 is not corrected (S24: Yes), the processing proceeds to step S28. When the position in the Y direction of the second region S2 is corrected (S24: No), the processing proceeds to step S26.

In step S26, the CPU 25 sets the length L3 as the correction data acquired from the operation unit 15 to an amount of shift, modifies the position in the +Y direction of the second region S2 in the +Y direction, and modifies the position in the −Y direction of the second region S2 in the −Y direction. In other words, a position of a part corresponding to the second region S2 in the sheet P is shifted in the Y direction with respect to the set position. Then, the processing proceeds to step S28, and after respective processes in step S28, step S30, and step S32 are performed, the processing proceeds to step S34.

In step S34, the CPU 25 checks whether to correct the position of the sheet P in the punch unit 40 or not. As an example, the CPU 25 acquires information of whether to correct the position of the sheet P or not and information of the length L4 as the transport correction data from the operation unit 15. When the position of the sheet P is corrected (S34: Yes), the processing proceeds to step S36. When the position of the sheet P is not corrected (S34: No), the processing proceeds to step S38.

In step S36, the CPU 25 corrects the position in the T direction of the sheet P transported to the punch unit 40. Specifically, the CPU 25, assuming that transport velocity of the sheet P by the first roller pair 54 and the second roller pair 57 is constant, corrects the position in the T direction of the sheet P facing the punch unit 40 by the length L4, by modifying an elapse time from when a downstream end in the T direction of the sheet P is detected in the sheet sensor 52 to when the transport of the sheet P is stopped. Then, the processing proceeds to step S38.

After the through hole A is formed in the second region S2 in step S38, step S40 is performed, and the sheet P is discharged. Then, the program PR ends.

As described above, according to the recording system 1 according to Exemplary Embodiment 2, when the position in the Y direction of the second regions S2 is corrected for each of the through holes A to form the two through holes A, a position shift of the two through holes A in the Y direction can be further suppressed.

Further, according to the recording system 1, the modification unit 50 corrects the position in the T direction of the sheet P based on the correction data input to the control unit 24. As a result, a position shift of the image G with respect to the two through holes A can be corrected uniformly in the T direction.

Exemplary Embodiment 3

Next, each configuration of Exemplary Embodiment 3, which is an example of the liquid ejecting device, the control method for the liquid ejecting device, and the control program for the liquid ejecting device according to the present disclosure will be described in detail below. Note that, portions and methods common to those in Exemplary Embodiment 1 and Exemplary Embodiment 2 are denoted by the same reference signs, and descriptions thereof will be omitted.

Figure 15:
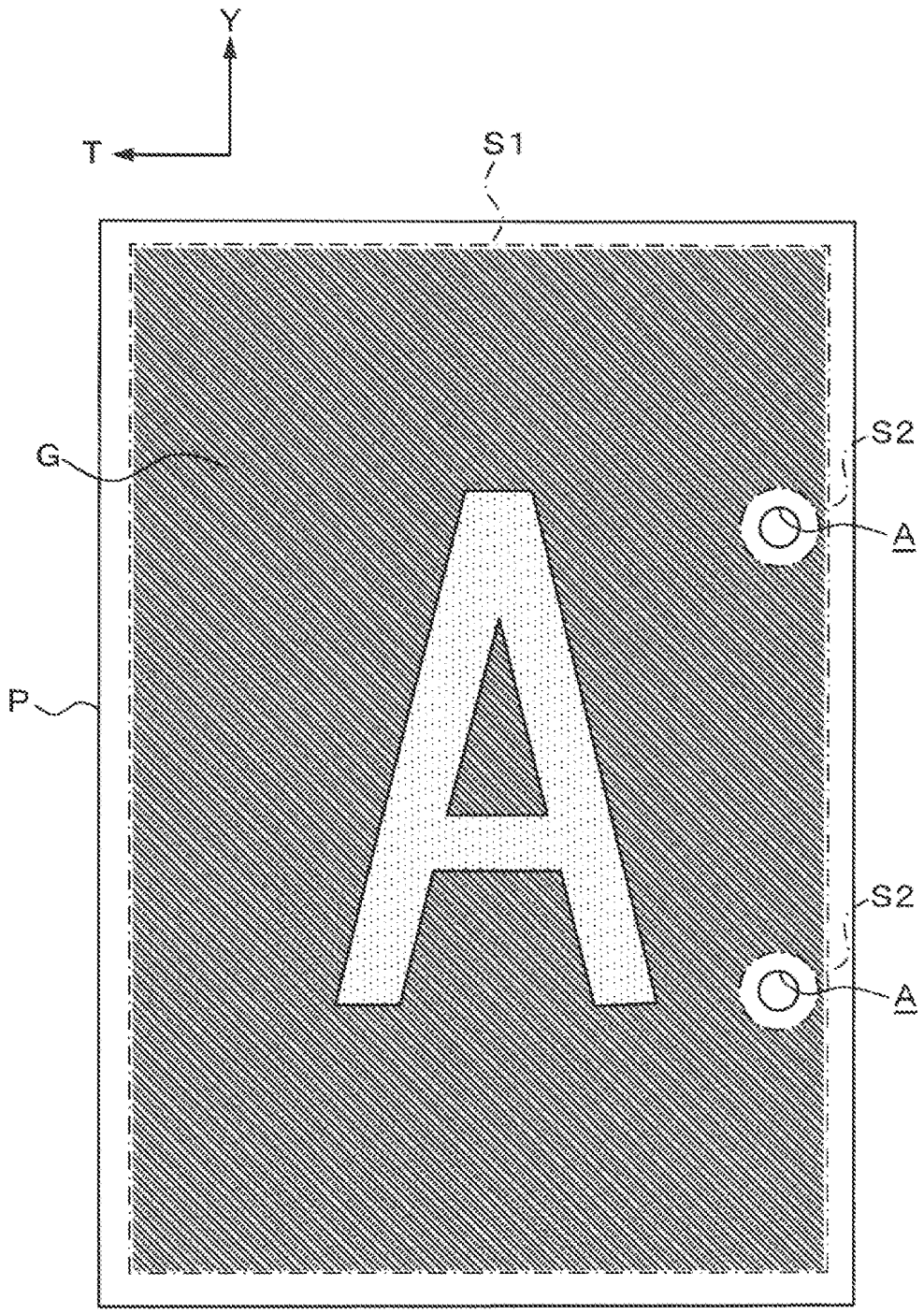
FIG. 15 is a plan view illustrating a first region, a second region, and through holes, set in a recording system according to Exemplary Embodiment 3.

As illustrated in FIG. 15, in the recording system 1 (FIG. 1) according to Exemplary Embodiment 3 is configured such that setting and position correction are possible for the first region S1 and the second region S2 in the same manner as in Exemplary Embodiment 2.

As a difference from Exemplary Embodiment 2, the control unit 24 ejects the ink Q from the ejecting unit 22 in the first region S1, and does not eject the ink Q from the ejecting unit 22 in the second region S2. In other words, a second ejection amount is set to zero.

In the sheet P after the image G is formed, the image G in a part corresponding to the second region S2 is not formed, and the image G of a part corresponding to the first region S1 is formed. Thus, in a state before the through hole A is formed, the ink Q does not adhere to the second regions S2.

In addition, the control unit 24 causes the nozzle inspection unit 23 to inspect a clogging state of the ejecting unit 22, at a time when the ejecting unit 22 faces the second region S2 of the sheet P.

Next, description is made of effects of the recording system 1 according to Exemplary Embodiment 3. Note that, for each unit constituting the recording system 1, reference is made to FIG. 1 to FIG. 3, and the description of the individual figure numbers is omitted.

According to the recording system 1, in the first region S1 of the sheet P, a part of the image G is formed by ejecting the ink Q from the ejecting unit 22 based on the image data DG.

On the other hand, when the ink Q is not ejected in the second region S2 of the sheet P, second image density of the image G formed in the second region S2 becomes lower than first image density of the image G formed in the first region S1 and becomes zero. As a result, when the through hole A is formed in the second region S2, a difference in density between a missing part of the image G due to the through hole A and the image G in the second region S2 is less compared to a case where the through hole A is formed in the first region S1, therefore, a position shift of the two through holes can be prevented from being conspicuous.

Additionally, according to the recording system 1, compared to a configuration in which the image G is formed in the second region S2, a total time required for the image forming processing to form the image G on the sheet P and the inspection processing of the clogging state of the ejecting unit 22 by the nozzle inspection unit 23 is shortened, as a result, throughput of image formation on the sheet P in the recording system 1 can be increased.

The recording system 1, the control method for the recording system 1, and the control program for the recording system 1 according to the exemplary embodiments of the present disclosure are based on the configuration described above. However, as a matter of course, modifications, omission, and the like may be made to a partial configuration without departing from the gist of the disclosure of the present application.

Figure 16:
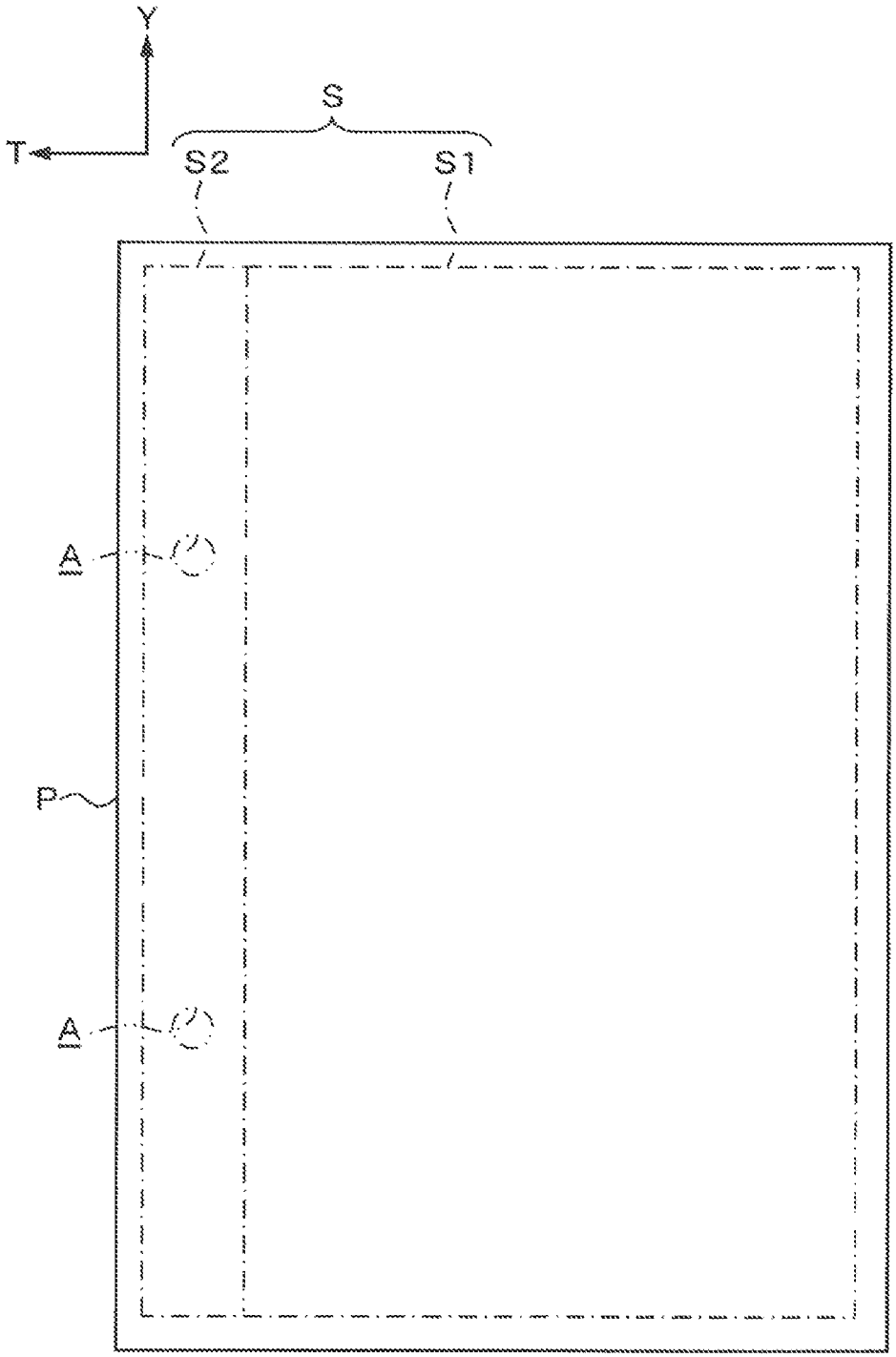
FIG. 16 is a plan view illustrating a region in which an image can be formed in a sheet used in a recording system according to a modification example.

As illustrated in FIG. 16, in the sheet P, the second region S2 may be located downstream the first region S1 in the T direction. In this case, it is sufficient that the punch unit 40 is disposed at a position adjacent to the first roller pair 54.

In the recording system 1, a second ejection amount may be stored in advance in the memory 26 without providing the setting unit 13. The memory 26 may store, in the data table DT, profile dimension data of the sheet P or a paper type of the sheet P as a parameter, instead of the thickness data of the sheet P. A value in the data table DT may be set to a value other than the value illustrated in FIG. 6.

The dimension in the T direction of the second region S2 may be greater than the dimension in the Y direction. The set dimension L2 may be stored in advance in the memory 26, without providing the operation unit 15. The modification unit 50 is not limited to a roller pair, and may be, for example, a combination of an endless belt and a roller. An air blowing unit may be provided in the recording system 1 to dry the ink Q on the sheet P.

The correction data and the transport correction data are not limited to the data input from the operation unit 15, but may be data input from an external device different from the recording system 1, or data stored in advance in the memory 26.

In the recording system 1, as a definition of undried, it is desirable that a time is set to within 3 [seconds], and more desirably within 2 [seconds], rather than 6 [seconds]. Additionally, as a definition of undried, a time with which a time from when ejection of the ink Q from the ejecting unit 22 is started, to when the sheet P faces the punch unit 40 is 6 [seconds] or greater may be defined.

The control unit 24 need not cause the nozzle inspection unit 23 to inspect the state of the ejecting unit 22, at the time when the ejecting unit 22 faces the second region S2 of the sheet P. In the recording system 1, during inspection by the nozzle inspection unit 23, ink Q may be ejected onto the subsequent sheet P. In other words, image formation of the second or subsequent sheet P may be started.

The medium is not limited to the sheet P, and may be film, cloth, or the like.

The number of through holes A is not limited to two, and may be three or more. The number of second regions S2 is not limited to one or two, and may be three or more.

Methods for changing the set dimension L2 according to a sheet thickness includes, a method in which the control unit 24 determines the dimension in the Y direction of the image data DG, and a method in which the control unit 24 limits a width of a dimension that can be specified by a user, a method in which the control unit 24 proposes a desirable dimension for a user, and a method in which whether or not to use, in addition to a change in the position in the T direction of the image G, a change in the position and removal of the image data DG in combination is switched.

Note that, as the correction data and the transport correction data, in addition to the data input from the operation unit 15, and the data acquired by the image reading unit 60, data set based on an original document read by the scanner unit 12 may be used.

An example of the second region S2 that is formed to be longer in the Y direction than in the T direction, is not limited to the second region S2 having the band-like shape or rectangular shape, and for example, the oval shaped second region S2 with the Y direction as a long axis direction and the T direction as a short axis direction may be used.

What is claimed is:

1. A liquid ejecting device, comprising:

an ejecting unit configured to eject liquid onto a medium transported by a transport unit to form an image;

a hole forming unit configured to form a plurality of through holes, arranged in a width direction intersecting a transport direction of the medium; and a control unit configured to control an ejection amount of the liquid per unit area based on image data, wherein the control unit divides a region in the medium in which an image is formed based on the image data into a first region not including the plurality of through holes, and a second region including the plurality of through holes, and controls an ejection amount of the liquid from the ejecting unit, so that a second ejection amount per unit area when an image is formed in the second region is less than a first ejection amount per unit area when an image is formed in the first region.

2. The liquid ejecting device according to claim 1, wherein the control unit performs division into the first region and the second region in the transport direction.

3. The liquid ejecting device according to claim 1, comprising:

a setting unit configured to set the second ejection amount, wherein the control unit controls ejection of the liquid from the ejecting unit so that an ejection amount of the liquid per unit area in the second region is the second ejection amount set by the setting unit.

4. The liquid ejecting device according to claim 1, wherein the control unit includes a storage unit for storing a data table, and the storage unit stores, in the data table, thickness data of the medium, and data of the second ejection amount corresponding to the thickness data.

5. The liquid ejecting device according to claim 1, wherein the control unit sets a dimension in the width direction of the second region to a dimension greater than a dimension in the transport direction of the second region.

6. The liquid ejecting device according to claim 1, wherein the control unit is configured to accept input of correction data for each of the through holes for correcting a position in the width direction of the second region, and correct the position in the width direction of the second region based on the input correction data.

7. The liquid ejecting device according to claim 1, comprising:

an operation unit configured to set a dimension in the transport direction of the second region, wherein the control unit performs division into the first region and the second region so that a dimension in the transport direction of the second region is a set dimension set by the operation unit.

8. The liquid ejecting device according to claim 1, comprising:

a modification unit configured to modify a position in the transport direction of the medium transported to the hole forming unit, wherein the control unit is configured to accept input of transport correction data for correcting a position in the transport direction of the medium, and operates the modification unit based on the input transport correction data, to correct the position in the transport direction of the medium.

9. The liquid ejecting device according to claim 1, wherein the hole forming unit forms the through hole in the medium, in a state in which the liquid ejected from the ejecting unit is undried in the medium.

10. The liquid ejecting device according to claim 1, comprising:

an inspection unit configured to inspect a state of the ejecting unit, wherein the control unit causes the inspection unit to inspect a state of the ejecting unit, in a time in which the ejecting unit faces the second region of the medium.

11. A liquid ejecting device, comprising:

an ejecting unit configured to eject liquid onto a medium transported by a transport unit to form an image;

a hole forming unit configured to form a plurality of through holes, arranged in a width direction intersecting a transport direction of the medium; and a control unit configured to control an ejection amount of the liquid per unit area based on image data, wherein the control unit divides a region in the medium, configured to be formed with an image based on the image data, into a first region not including the plurality of through holes, and a second region including the plurality of through holes, is configured to accept input of correction data for each of the through holes for correcting a position in the width direction of the second region, corrects the position in the width direction of the second region based on the input correction data, causes the ejecting unit to eject the liquid in the first region, and causes the ejecting unit not to eject the liquid in the second region.

12. A control method for a liquid ejecting device that includes an ejecting unit for ejecting liquid onto a medium transported by a transport unit to form an image, a hole forming unit for forming a plurality of through holes, arranged in a width direction intersecting a transport direction of the medium, and a control unit for controlling an ejection amount of the liquid per unit area based on image data, the control method comprising:

dividing, when the plurality of through holes are formed in the medium, a region in the medium in which an image is formed based on the image data into a first region not including the plurality of through holes, and a second region including the plurality of through holes; and controlling an ejection amount of the liquid from the ejecting unit, so that a second ejection amount per unit area when an image is formed in the second region is less than a first ejection amount per unit area when an image is formed in the first region.

13. A non-transitory computer-readable storage medium storing a control program for a liquid ejecting device that includes an ejecting unit for ejecting liquid onto a medium transported by a transport unit to form an image, a hole forming unit for forming a plurality of through holes, arranged in a width direction intersecting a transport direction of the medium, and a control unit for controlling an ejection amount of the liquid per unit area based on image data, the control program causing a computer to:

divide, when the plurality of through holes are formed in the medium, a region in the medium in which an image is formed based on the image data into a first region not including the plurality of through holes, and a second region including the plurality of through holes; and control an ejection amount of the liquid from the ejecting unit, so that a second ejection amount per unit area when an image is formed in the second region is less than a first ejection amount per unit area when an image is formed in the first region.

* * * * *